US010277974B2

(12) United States Patent
Shiomi et al.

(10) Patent No.: US 10,277,974 B2
(45) Date of Patent: Apr. 30, 2019

(54) HEADPHONE

(71) Applicant: SONY CORPORATION, Tokyo (JP)

(72) Inventors: Shunsuke Shiomi, Tokyo (JP); Tomohiro Ito, Tokyo (JP); Yosuke Nakamura, Tokyo (JP); Nobuyuki Ishizaku, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 14/899,021

(22) PCT Filed: May 1, 2014

(86) PCT No.: PCT/JP2014/002383
§ 371 (c)(1),
(2) Date: Dec. 16, 2015

(87) PCT Pub. No.: WO2014/207979
PCT Pub. Date: Dec. 31, 2014

(65) Prior Publication Data

US 2016/0127819 A1 May 5, 2016

(30) Foreign Application Priority Data

Jun. 28, 2013 (JP) ..... 2013-137181

(51) Int. Cl.
*H04R 1/00* (2006.01)
*H04R 1/10* (2006.01)
*H04R 5/033* (2006.01)

(52) U.S. Cl.
CPC ..... *H04R 1/1066* (2013.01); *H04R 1/105* (2013.01); *H04R 1/1008* (2013.01); *H04R 1/1033* (2013.01); *H04R 5/0335* (2013.01)

(58) Field of Classification Search
CPC .... H04R 1/1008; H04R 1/1066; H04R 5/033; H04R 5/0335
See application file for complete search history.

(56) References Cited

U.S. PATENT DOCUMENTS

2007/0297633 A1 12/2007 Kaulfuss et al.
2010/0067714 A1* 3/2010 Cheng ..... H04R 1/2857 381/74

(Continued)

FOREIGN PATENT DOCUMENTS

CN 101656903 2/2010
CN 202168189 3/2012

(Continued)

OTHER PUBLICATIONS

International Search Report prepared by the Japanese Patent Office on Jul. 4, 2014, for International Application No. PCT/JP2014/002383.

(Continued)

*Primary Examiner* — Matthew A Eason
(74) *Attorney, Agent, or Firm* — Sheridan Ross P.C.

(57) ABSTRACT

A headphone includes: a headband; a pair of housing support portions, one and the other of which are provided at one and the other ends of the headband, respectively; a pair of rotational shafts, one and the other of which rotatably connect one and the other of the pair of housing support portions to the headband, respectively; a pair of housings, one and the other of which are provided on one and the other of the pair of housing support portions, respectively, wherein, in a folded state of the housing support portions as a result of a rotation, the pair of housings are disposed in positions contained within an area inside an arc formed by the headband and the housing support portions in an opened state of the housing support portions, and are located side by side without crossing each other; and a pair of ear pads.

19 Claims, 20 Drawing Sheets

(56) References Cited

U.S. PATENT DOCUMENTS

| | | | | |
|---|---|---|---|---|
| 2011/0129111 | A1* | 6/2011 | Santiago | H04R 5/0335 381/379 |
| 2012/0099754 | A1* | 4/2012 | Petersen | H04R 1/1066 381/379 |
| 2013/0177165 | A1* | 7/2013 | Oishi | H04R 1/1041 381/74 |

FOREIGN PATENT DOCUMENTS

| | | | |
|---|---|---|---|
| JP | S57-062938 | | 4/1982 |
| JP | S58166193 | U | 11/1983 |
| JP | 09-247783 | A | 9/1997 |
| JP | 2004-236324 | A | 8/2004 |
| JP | 2005-527134 | A | 9/2005 |
| JP | 2006-086980 | A | 3/2006 |
| JP | 2013-038671 | A | 2/2013 |

OTHER PUBLICATIONS

Official Action (with English translation) for Japanese Patent Application No. 2015-523830, dated Jun. 26, 2018, 15 pages.
Official Action (with English translation) for Chinese Patent Application No. 201480035253.0, dated Apr. 18, 2018, 19 pages.

* cited by examiner

A

B

A

B

A

B

HEADPHONE

CROSS REFERENCE TO RELATED APPLICATIONS

This application is a national stage application under 35 U.S.C. 371 and claims the benefit of PCT Application No. PCT/JP2014/002383 having an international filing date of May 1, 2014, which designated the United States, which PCT application claimed the benefit of Japanese Patent Application No. 2013-137181 filed Jun. 28, 2013, the disclosures of which are incorporated herein by reference in their entirety.

TECHNICAL FIELD

The present technology relates to a headphone.

BACKGROUND ART

A headphone has been used as a device through which sound output from an audio reproduction device is heard. A typical headphone includes a headband provided in contact with the head of a user, and housings provided on the left and right ends of the headband. Each of the housings accommodates an audio output means constituted by a speaker or the like. There are known a considerable number of types and folding systems of a headphone (Patent Document 1, Patent Document 2). A known foldable headphone often includes two or three, or more folding rotational shafts disposed on each of an L side and an R side.

CITATION LIST

Patent Documents

Patent Document 1: Japanese Patent Application Laid-Open No. 2004-236324

Patent Document 2: Japanese Translation of PCT International Application Publication No. 2005-527134

SUMMARY OF THE INVENTION

Problems to be Solved by the Invention

However, in case of a headphone provided with many folding rotational shafts, a user operating this headphone is required to perform a complicated folding operation, as has been a problem of this type of headphone.

The present technology has been developed in consideration of this problem. It is an object of the present technology to provide an easily foldable headphone.

Solution to Problems

For solving the above-mentioned problem, the present technology is directed to a headphone including: a headband; a pair of housing support portions, one and the other of which are provided at one and the other ends of the headband, respectively; a pair of rotational shafts, one and the other of which rotatably connect one and the other of the pair of housing support portions to the headband, respectively; a pair of housings, one and the other of which are provided on one and the other of the pair of housing support portions, respectively, wherein, in a folded state of the housing support portions as a result of a rotation, the pair of housings are disposed in positions contained within an area inside an arc formed by the headband and the housing support portions in an opened state of the housing support portions, and are located side by side without crossing each other; and a pair of ear pads, one and the other of which are provided on one and the other of the pair of housings, respectively.

Effects of the Invention

According to the present technology, a headphone becomes easily foldable.

BRIEF DESCRIPTION OF DRAWINGS

FIG. 1A is a view illustrating a use state of a headphone according to a first embodiment of the present technology, while FIG. 1B is a view illustrating a sliding state of a slider.

FIG. 2A is a view illustrating a state of the headphone during folding, while FIG. 2B is a view illustrating a folded state of the headphone.

FIG. 9A is a view illustrating an area formed by the headband and the arm, while FIG. 9B is a view illustrating such a state where the housings are located within the area formed by the headband and the arm in the folded state of the headphone.

FIG. 12A is a view illustrating a state of the headphone during folding, while FIG. 12B is a view illustrating a folded state of the headphone.

FIG. 19A is a view illustrating a state of insertion of the rotational shaft into a shaft insertion hole of the hanger, while FIG. 19B is a cross-sectional view of the state of insertion of the rotational shaft into the shaft insertion hole of the hanger.

FIG. 20A is a view illustrating an area formed inside the headphone, while FIG. 20B is a view illustrating such a state where the housings are located within the area in the folded state of the headphone.

FIG. 21A is a view illustrating a use state of a headphone according to a modified example of the present technology, while FIG. 21B is a view illustrating a folded state of the headphone according to the modified example.

MODE FOR CARRYING OUT THE INVENTION

Figure 1:
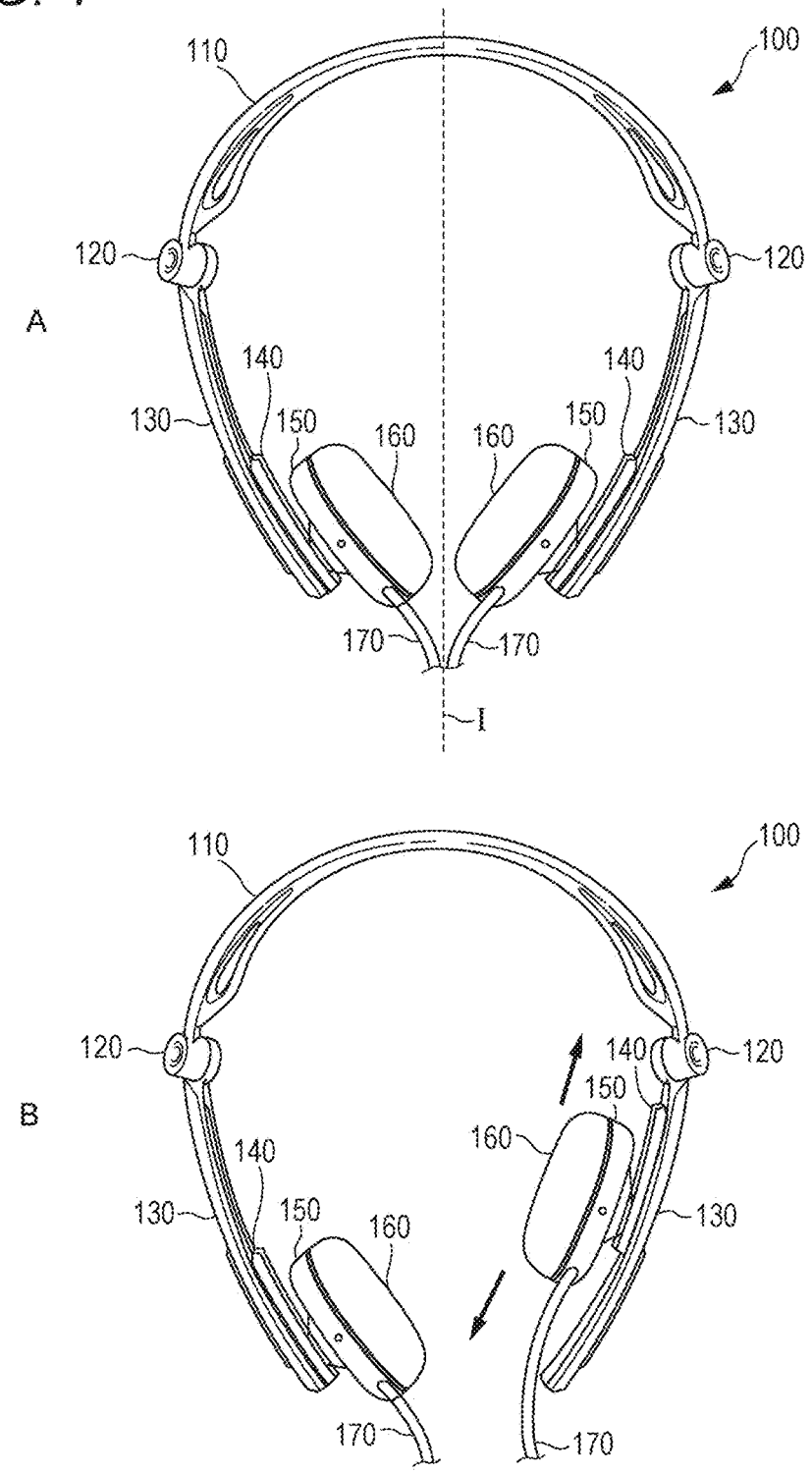

Embodiments according to the present technology are hereinafter described with reference to the drawings. The description will be presented in the following order.

<1. First Embodiment>

[1-1. Configuration of Headphone]

<2. Second Embodiment>

[2-1. Configuration of Headphone]

<3. Modified Examples>

<1. First Embodiment>

[1-1. Configuration of Headphone]

FIGS. 1A and 1B and FIGS. 2A and 2B illustrate a general configuration of a headphone 100 according to the present technology. The headphone 100 is constituted by a headband 110, rotational shafts 120, arms 130, sliders 140, housings 150, ear pads 160, and cords 170.

The headband 110 is curved along the head of a user, and brought into contact with the top of the head of the user in a wearing state to support the entire headphone 100. The headband 110 is constituted by synthetic resin such as plastic, or metal, for example, and has flexibility produced by predetermined rigidity and elasticity of the headband 110. Accordingly, the headband 110 is capable of pressing the housings 150 and the ear pads 160 toward the side of the head of the user during wearing of the headphone 100, thereby maintaining the wearing state of the headphone 100. A cushioning member such as rubber may be provided on a portion of the inner surface of the headband 110 in contact with the top of the head of the user.

One and the other of the rotational shafts 120 are provided on one and the other ends of the headband 110, respectively, to rotatably connect the arms 130 to the headband 110. Each of the rotational shafts 120 is tilted at a predetermined angle in a diagonal direction. The detailed configuration of the rotational shafts 120 will be described later. According to the first embodiment, the L side rotational shaft 120 and the R side rotational shaft 120 are disposed at bilaterally symmetric positions.

Figure 2:
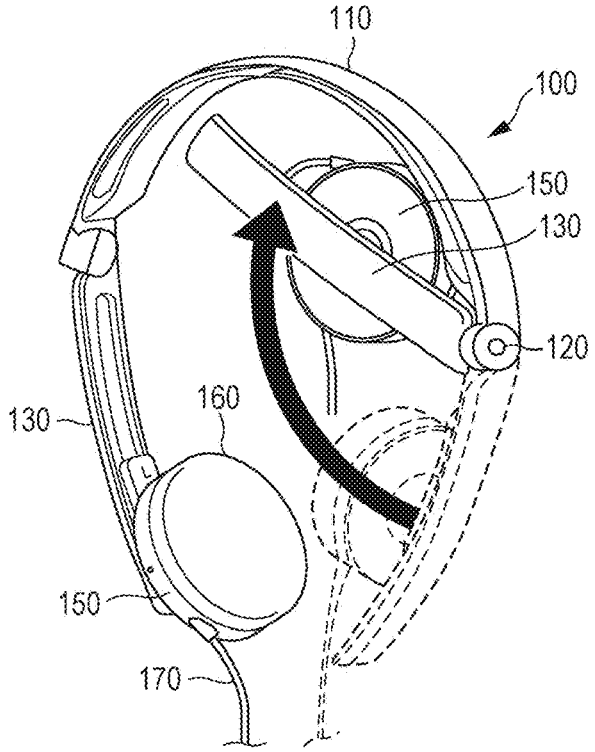
Figure 2:
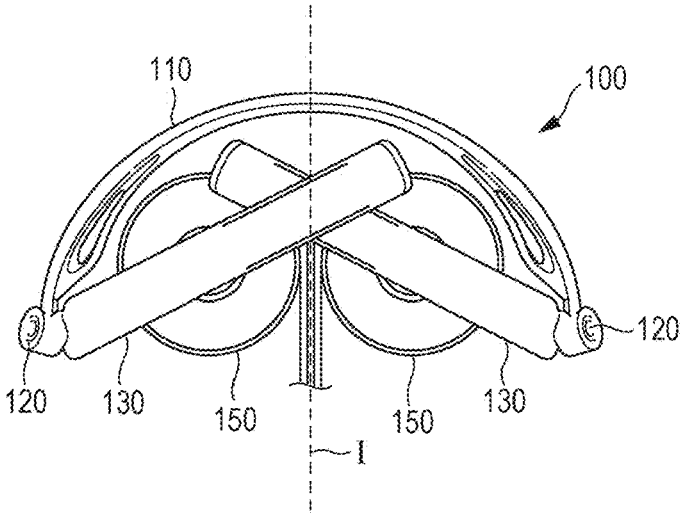

The arms 130 are slightly curved along the side of the head of the user. The arms 130 are rotatably connected with the one and the other ends of the headband 110, respectively, with the rotational shafts 120 interposed between the arms 130 and the headband 110. Each of the arms 130 is foldable as illustrated in FIG. 2A by rotation around an axis of the corresponding rotational shaft 120. The arms 130 are constituted by synthetic resin such as plastic, or metal, for example. A state of the arms 130 not folded and allowing use of the headphone 100 by the user as illustrated in FIG. 1A is hereinafter referred to as a use state.

The sliders 140 are slidable in the up-down direction along the inner side surfaces of the arms 130. The sliders 140 support the housings 150, wherefore the user is capable of shifting the housings 150 in the up-down direction by sliding the sliders 140 along the arms 130. The arms 130 and the sliders 140 correspond to housing support portions according to the claims.

During wearing of the headphone 100, each of the housings 150 and each of the ear pads 160 are aligned with a position facing the corresponding ear of the user by adjustment of the position of the corresponding slider 140 in accordance with the size of the head of the user, the distance between the ear and the top of the head, and others. This alignment produces fitting comfort in accordance with physical features and preferences of the user. When the headphone 100 is not used, each of the sliders 140 is slid to a folding position located at the upper end of a slidable range to bring the headphone 100 into a compact condition. This point will be described later.

The housings 150 connected with the sliders 140 face the inside of the headphone 100. The housings 150 are supported by the sliders 140 in such a condition that each of the housings 150 can perform a twisting action. In this case, the direction of each of the housings 150 changes in accordance with the shape of an area around the ear of the user during wearing of the headphone 100, wherefore the housing 150 comes to the position facing the ear in a state appropriate for the shape of the side of the head of the user. Connection between the sliders 140 and the housings 150 will be detailed later.

Each of the housings 150 functions as an accommodating unit for accommodating an audio processing circuit, a speaker (both not shown), and others inside the housing 150. Each of the housings 150 is constituted by synthetic resin such as plastic, for example. The audio processing circuit executes predetermined audio signal processes, such as a noise canceling process, a signal amplifying process, and an equalizing process. The speaker outputs audio signals processed by the audio processing circuit in the form of sound.

Each of the ear pads 160 is configured to have elasticity, and provided on the corresponding housing 150 on a surface facing the side of the head of the user. Each of the ear pads 160 interposed between the corresponding housing 150 and the side of the head of the user functions as a cushioning member between the housing 150 and the side of the head of the user. More specifically, the ear pads 160 prevent discomfort or pain given to the user from the housings 150 made of hard and not easily deformable material and coming in direct contact with the side of the head of the user during wearing of the headphone 100.

In addition, each of the ear pads 160 has a function of improving sound quality, such as enhancement of reproduction of a low range, by sealing a space formed by the ear pad 160 and the side of the head of the user when the ear pad 160 is ring-shaped. Moreover, each of the ear pads 160 has a function of preventing leakage of sound to the outside after output of sound from the speaker. Furthermore, each of the ear pads 160 has a function of blocking noise entering from the outside to allow the user to more easily hear sound generated from the speaker.

Each of the cords 170 is a cord into which a lead, a ground line and the like are inserted, as a cord through which audio signals are transmitted. One end of each of the cords 170 is connected with the audio processing circuit accommodated in the corresponding housing 150. A plug (not shown) is provided at the other end of each of the cords 170. This plug is connected with an audio reproduction device (not shown) such as an MP3 (MPEG Audio Layer-3) player for connection between the headphone 100 and the audio reproduction device. According to the example illustrated in FIGS. 1A and 1B and FIGS. 2A and 2B, cords 170 are provided such that one and the other of the cords 170 are connected with the L side housing 150 and the R side housing 150, respectively. As can be seen from FIG. 2B, the L side housing 150 and the R side housing 150 come close to each other when the headphone 100 is in a folded state. Accordingly, it is preferable that connection portions of the cords 170 are determined such that the connection portion of the L side cord 170 and the connection portion of the R side cord 170 do not contact each other when the headphone 100 is in the folded state.

The cord 170 may be connected with only either the L side housing 150 or the R side housing 150. In this case, an L channel lead, an R channel lead, and a ground line are inserted into the cord 170. A connection cord (not shown) is further provided between the housing 150 connected with the cord 170, and the other housing 150 not connected with the cord 170 to drive the speaker within the other housing 150 not connected with the cord 170. This connection cord is connected with the cord 170 or the audio processing circuit within the housing 150 connected with the cord 170, and inserted into the sliders 140, arms 130, and the headband 110 to connect with the audio processing circuit within the other housing 150. Audio signals are transmitted via this connection cord to the audio processing circuit of the other housing 150 not connected with the cord 170.

According to the headphone 100 in the first embodiment, one of the L side and R side sliders 140 is initially slid along the arm 130 to the upper end of the slidable range as illustrated in FIG. 1B when the headphone 100 is not used. Then, the arm 130 on the side of the slider 140 slid to the upper end of the slidable range is rotated and folded toward the headband 110 as illustrated in FIG. 2A.

These steps are also performed for the other slider 140 and arm 130. In this case, the arm 130 corresponding to the one slider 140 is folded after sliding of the one slider 140, whereafter the arm 130 corresponding to the other slider 140 is folded after the sliding of the other slider 140. However, both the arms 130 may be folded after sliding of both the sliders 140.

When the L side arm 130 and the R side arm 130 are folded, the headphone 100 comes into a folded state as illustrated in FIG. 2B. This folded state of the L side arm 130 and the R side arm 130 is hereinafter referred to as a folded state.

Each of the housings 150 makes a directional change from a state facing a plane I located at equal distances from the L side and R side housings 150 in the use state (state in FIG. 1A), to a state substantially perpendicular to the plane I (state in FIG. 2B) in accordance with rotation of the arm 130. This change applies to the ear pads 160 provided on the housings 150. When the headphone 100 is not used or carried to a different place, for example, the headphone 100 is brought into the folded state for size reduction of the headphone 100, thereby achieving space saving for storage of the headphone 100.

Figure 3:
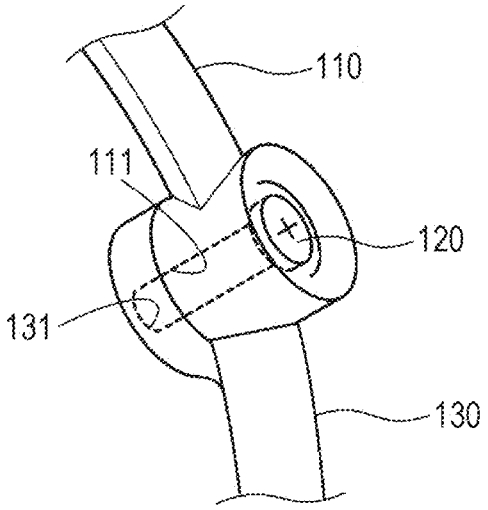
FIG. 3 is a partial enlarged view of a connection portion between the headband and an arm.

A configuration of the rotational shafts 120 is now described. As discussed above, the rotational shafts 120 are tilted in a diagonal direction with respect to the plane I located at equal distances from the L side and R side housings 150. As illustrated in FIG. 3, for example, each of the rotational shafts 120 is inserted into both a shaft insertion hole 111 formed at one end of the headband 110, and a shaft insertion hole 131 formed at the upper end of the arm 130. This structure allows rotation of the arms 130 with respect to the headband 110.

FIGS. 4A to 4E are views illustrating a method for determining optimum position and tilt of each of the rotational shafts 120. A headphone 1 illustrated in FIGS. 4A to 4E is a schematic illustration, assuming that the headphone 1 includes one curved band 2, and housings 3 disposed at both ends of the band 2.

Initially, an optimum position of one of the housings 3 in the folded state of the headphone 1 is determined. It is preferable that this position corresponds to such a position that the size of the headphone 1 becomes the minimum in the folded state. Based on this determination, a folding position A of the band 2 is determined in accordance with the position of the housing 3 and the length of the band 2 as illustrated in FIG. 4A.

Figure 4:
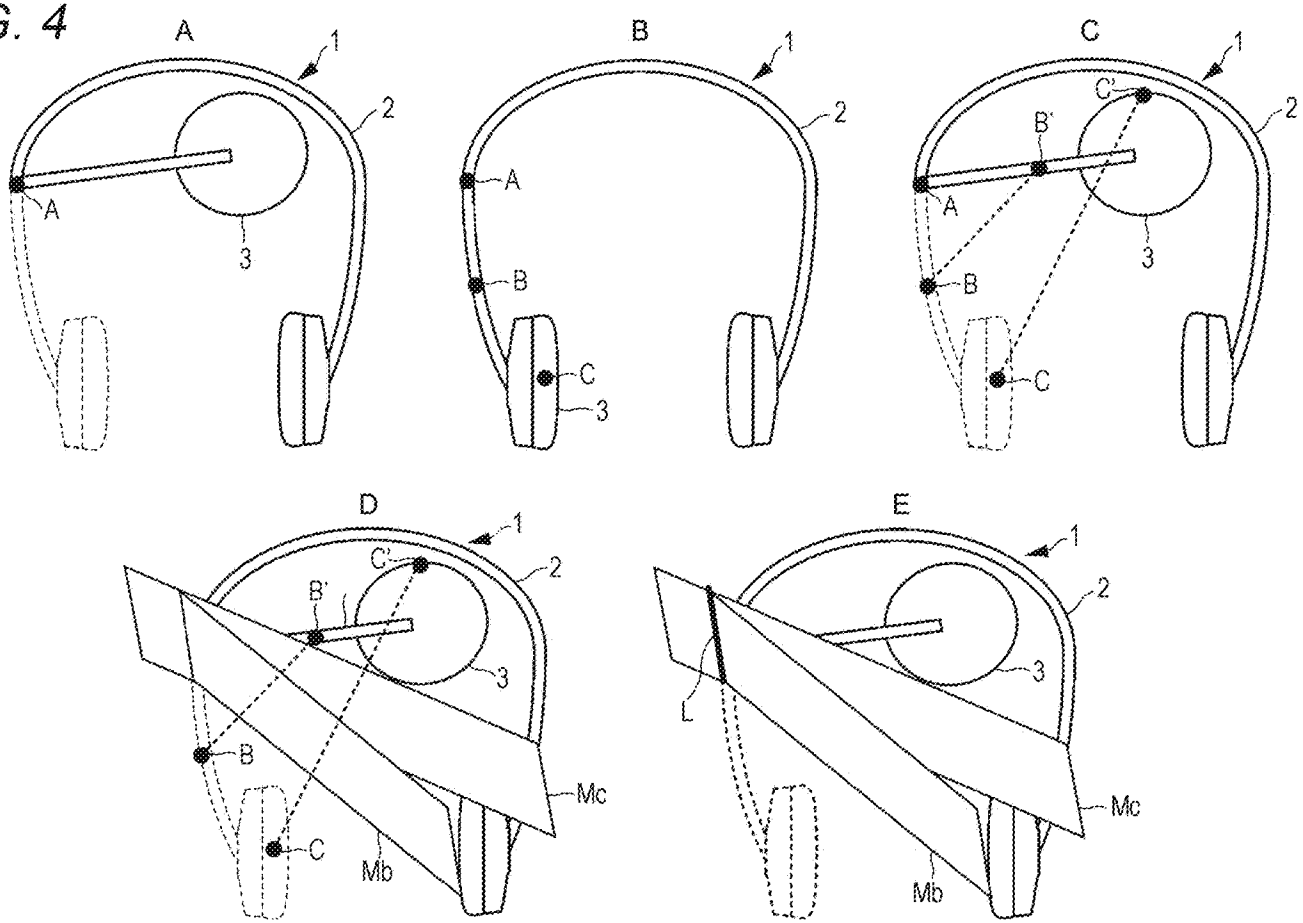
FIGS. 4A to 4E are views illustrating a method for determining a folding position of the headphone.

Subsequently, arbitrary two points are determined on the housing 1 and/or on the band 2 as illustrated in FIG. 4B. According to the example in FIG. 4B, a point B is determined on the band 2, while a point C is determined on the housing 3. The points B and C are provided below the point A corresponding to the folding position in the use state of the headphone 1.

Subsequently, the band 2 is folded at the determined folding position A as illustrated in FIG. 4C. It is assumed that the points B and C are shifted to positions B' and C', respectively, after this folding.

Then, a plane Mb is determined between the point B and the point B' as a plane located at equal distances from the point B and the point B' as illustrated in FIG. 4D. The plane Mb is considered as a group of points located at equal distances from the two points B and B'. Similarly, a plane Mc is determined between the point C and the point C' as a plane located at equal distances from the points C and C'. The plane Mc is considered as a group of points located at equal distances from the two points C and C'.

As illustrated in FIG. 4E, a line L along which the plane Mb and the plane Mc cross each other corresponds to the direction of the rotational shaft 120. The tilt of the rotational shaft 120 is determined by this method. The optimum positions and tilts of the rotational shafts are determined in this manner.

According to this embodiment, the headband 110 and the arm 130 are connected with each other via the rotational shaft 120, in which condition the arm 130 is foldable in accordance with rotation of the arm 130 as described with reference to FIGS. 1A and 1B and FIGS. 2A and 2B. Accordingly, it is preferable that the headband 110 and the arm 130 are connected with alignment between the rotational shaft 120 and the folding position C obtained by the method illustrated in FIGS. 4A to 4E.

The tilt of the rotational shaft 120 in a diagonal direction realizes folding of the arm 130 and a change of the direction of the housing 150 by one rotation around the axis of the rotational shaft 120. The one rotation of the arm 130 changes the direction of the housing 150 facing the plane I located at equal distances from the left and right housings 150 in the use state. A conventional headphone requires two or more operations, including one operation for folding the headphone, and one operation for changing the direction of the housing. However, the headphone 100 according to the present technology realizes folding of the headphone 100 and a change of the direction of the housing 150 by one arm rotation.

Figure 5:
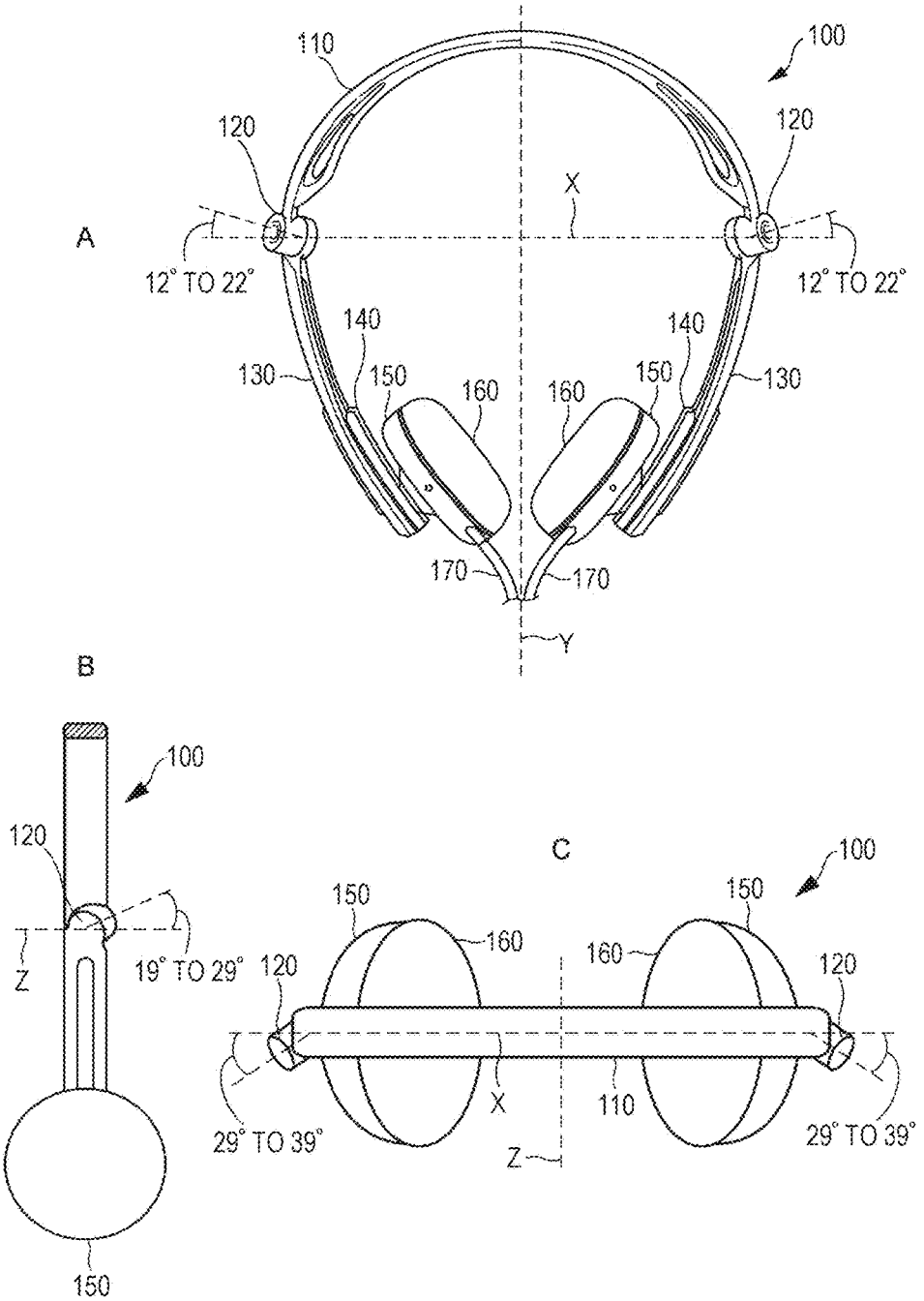
FIG. 5A is a view illustrating an angle of each rotational shaft in an X-Y plane.
FIG. 5B is a view illustrating an angle of each rotational shaft in a Y-Z plane.
FIG. 5C is a view illustrating an angle of each rotational shaft in an X-Z plane.

As illustrated in FIG. 5A, it is preferable that each of the rotational shafts 120 is disposed at an angle approximately in a range from 12° to 22° with respect to an X axis perpendicular to a Y axis dividing an arc of the headband 110 into two equal parts in the front view of the headphone 100. It is further preferable that each of the rotational shafts 120 is disposed at an angle of approximately 17° with respect to the X axis in the front view.

As illustrated in FIG. 5B, it is preferable that each of the rotational shafts 120 is disposed at an angle approximately in a range from 19° to 29° with respect to a Z axis substantially parallel with the width direction of the headband 110 in the side view of the headphone 100. It is further preferable that each of the rotational shafts 120 is disposed at an angle of approximately 24° with respect to the Z axis in the side view.

As illustrated in FIG. 5C, it is preferable that each of the rotational shafts 120 is disposed at an angle approximately in a range from 29° to 39° with respect to the X axis substantially in parallel with the longitudinal direction of the headband 110 in the top view of the headphone 100. It is further preferable that each of the rotational shafts 120 is disposed at an angle of approximately 34° with respect to the X axis in the top view.

Figure 6:
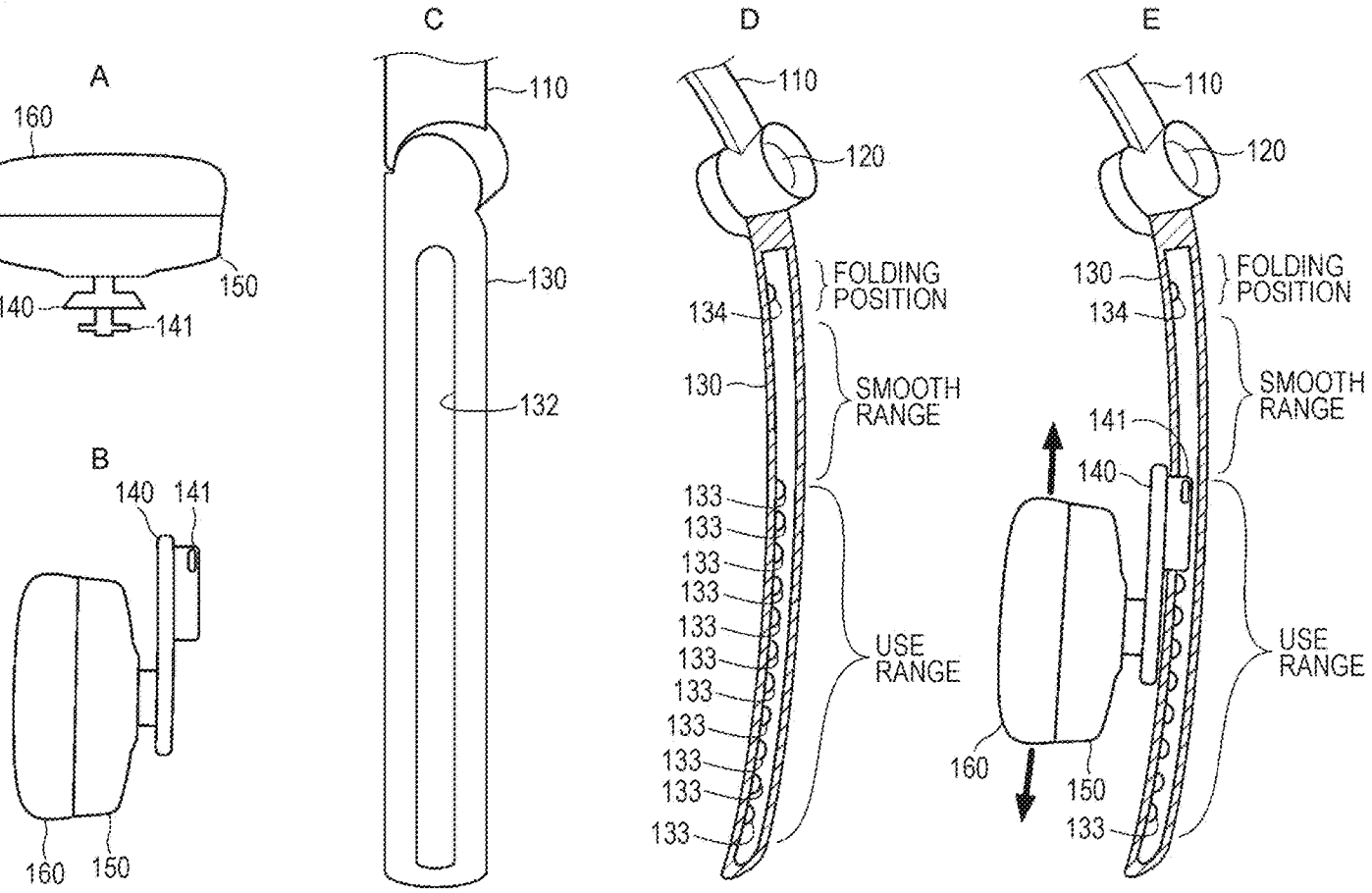
FIG. 6A is a top view of the slider, a housing, and an ear pad.
FIG. 6B is a side view of the slider, the housing, and the ear pad.
FIG. 6C is an inside front view of the arm.
FIG. 6D is a cross-sectional side view of the arm.
FIG. 6E is a cross-sectional side view of the arm in a state of connection between the arm and the slider.

Configurations of the arm 130 and the slider 140 are now described. FIG. 6A is a top view of the slider 140, the housing 150, and the ear pad 160. FIG. 6B is a side view of the slider 140, the housing 150, and the ear pad 160. FIG. 6C is an inside view of the arm 130. FIG. 6D is a cross-sectional side view of the arm 130. FIG. 6E is a cross-sectional side view of the arm 130 to which the slider 140 is connected.

As illustrated in FIGS. 6A and 6B, the slider 140 includes an engaging projection 141 which is T-shaped in the top view and engages with the inside of the arm 130.

As illustrated in FIG. 6C, a guide groove 132 is formed in the inner surface of the arm 130. The guide groove 132 is a groove in which the slider 140 is slidable along the arm 130 in a state of insertion of the engaging projection 141 into the arm 130. As illustrated in FIG. 6D, a cavity is formed inside the arm 130 so that the engaging projection 141 of the slider 140 becomes slidable.

A plurality of use-state projections 133 are provided on the inner side surface of the arm 130. The engaging projection 141 of the slider 140 is caught by the plurality of use-state projections 133 at the time of fixture of the position of the housing 150. A range of the use-state projections 133 coincides with a range of sliding of the slider 140 for adjustment of the position of the housing 150 by the user during use of the headphone 100. This range is therefore referred to as a use range. The use-state projections 133 correspond to a first position fixing mechanism according to the claims. The housing 150 and the ear pad 160 is aligned with the position facing the ear of the user by adjusting the position of the slider 140 in accordance with the size of the head of the user, the distance between the ear and the top of the head, or other conditions, and fixing the adjusted position of the slider 140. This alignment produces fitting comfort in accordance with physical features and preferences of the user.

Figure 11:
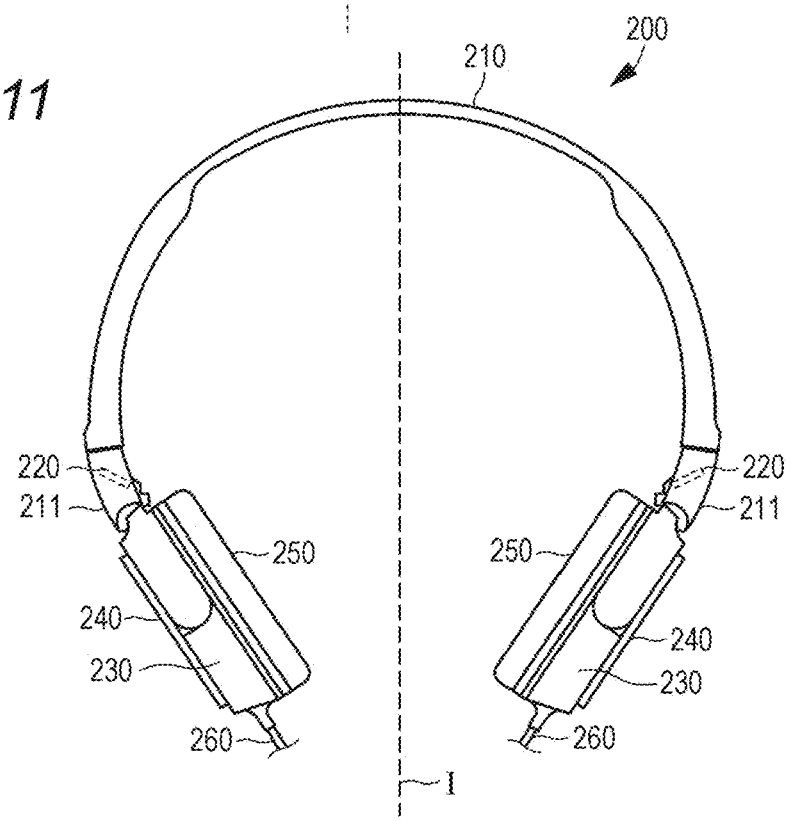
FIG. 11 is a view illustrating a use state of a headphone according to a second embodiment of the present technology.

According to the example illustrated in FIG. 6D, 11 pieces of the use-state projections 133 are provided. However, the number of the use-state projections 133 is not limited to this number. Finer adjustment of the position of the housing is achievable by the user as the number of the use-state projections 133 becomes larger.

In addition, one folded-state projection 134 is provided in an upper part of the inner side surface of the arm 130. The folded-state projection 134 fixes the position of the housing 150 at the time of folding of the headphone 100. The position of the folded-state projection 134 coincides with the position of the housing 150 at the time of folding of the arm 130. Accordingly, this position is referred to as a folding position. The folded-state projection 134 corresponds to a second position fixing mechanism according to the claims.

There is provided a range containing no projection between the use range and the folded-state position. No projection is provided in the range between the use range and the folded-state position, wherefore the slider 140 is capable of smoothly sliding in the range between the use range and the folded-state position. The range between the use range and the folded-state position is hereinafter referred to as a smooth range.

As illustrated in FIG. 6E, the slider 140 is slidable upward and downward along the arm 130 in the state of insertion of the engaging projection 141 of the slider 140 into the arm 130. At the time of adjustment of the position of the housing 150 for use of the headphone 100, the user slides the slide upward or downward within the use range.

As a result, the engaging projection 141 of the slider 140 is caught by the use-state projections 133 for fixation of the position of the slider 140. Accordingly, the housing 150 is fixable to a position corresponding to a preference of the user. In this case, the user realizes that the position of the housing 150 has been adjusted based on the click feeling given to the user when the engaging projection 141 of the slider 140 climbs over the use-state projections 133.

When the headphone 100 is not used and desired to be folded, the slider 140 is slid through the smooth range toward the folding position. As a result, the engaging projection 141 of the slider 140 is caught by the folded-state projection 134, whereby the slider 140 is fixed to the folding position of the slider 140.

No projection is provided in the smooth range between the use range and the folding position. Accordingly, the user is capable of smoothly sliding the slider 140 in the smooth range. The smooth range is neither the range for fixing the position of the housing 150 during use, nor a range for positioning the housing 150 during storage. Accordingly, no projection needs to be formed in the smooth range. The absence of a projection in the smooth range allows the user to easily and rapidly slide the slider 140. Accordingly, folding of the headphone 100 rapidly finishes.

As described above, the slidable range of the slider 140 according to the present technology is wider than the position changeable range of the housing 150 during use of the headphone 100. According to this structure, the housing 150 is slidable to the upper end of the arm 130 at the time of storage of the headphone 100, thereby increasing the compactness of the headphone 100.

Figure 7:
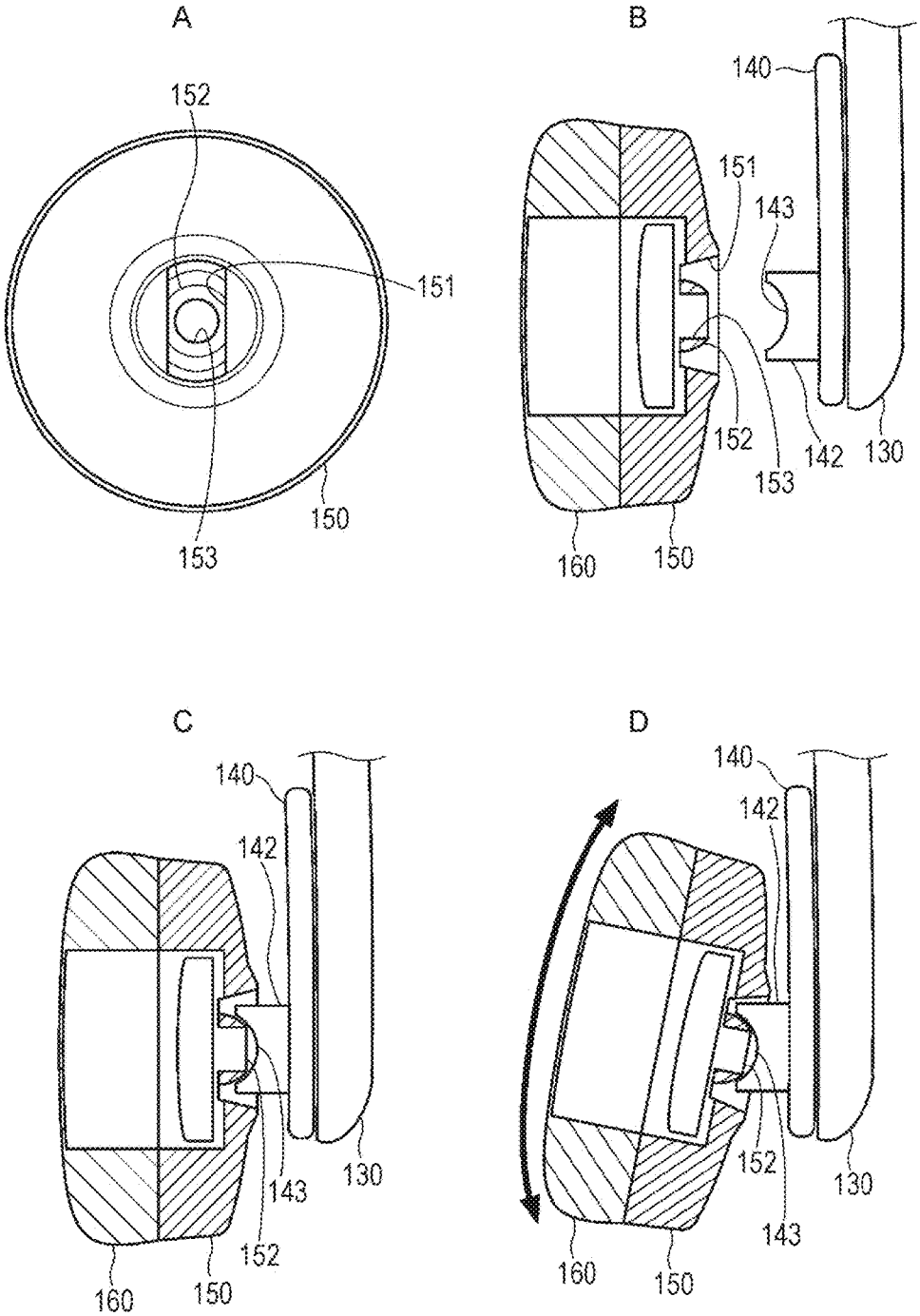
FIG. 7A is a plan view of the housing.
FIG. 7B shows a side view of the slider and a cross-sectional view of the housing and the ear pad.
FIG. 7C is a side view of a state of connection between the slider and the housing.
FIG. 7D is a side view illustrating a state of connection between the slider and the housing, and a moving state of the housing.

The connection between the slider 140 and the housing 150 is now described. FIG. 7A is a view illustrating a surface of the housing 150 on the side opposite to the side where the ear pad 160 is provided. FIG. 7B is a side view of the arm 130, the slider 140, the housing 150, and the ear pad 160. FIG. 7C is a side view illustrating a state of connection between the slider 140 and the housing 150. FIG. 7D is a side view illustrating a moving state of the housing 150 under the state of connection between the slider 140 and the housing 150. FIGS. 7B, 7C and 7D show cross sections of the housing 150 and the ear pad 160.

An elongated recess 151 is formed substantially at the center of the surface of the housing 150 on the side opposite to the side where the ear pad 160 is provided. As illustrated in FIG. 7B, a projecting spherical surface 152 having a projecting spherical shape in the side view is provided substantially at the center of the recess 151. A connection hole 153 is further formed substantially at the center of the projecting spherical surface 152.

As illustrated in FIG. 7B, a projection-shaped housing connection portion 142 is provided on the slider 140. A recessed spherical surface 143 having a recessed spherical shape in the front view is formed at the tip of the housing connection portion 142. The housing connection portion 142 is provided to tiltably support the housing 150.

The slider 140 and the housing 150 are connected with each other via a screw of the like inserted into the connection hole 153 of the housing 150 in a state of abutment between the recessed spherical surface 143 of the slider 140 and the projecting spherical surface 152 of the housing 150. As a result, the projecting spherical surface 152 of the housing 150 becomes slidable with respect to the recessed spherical surface 143 of the slider 140 as illustrated in FIG. 7D. In this case, the housing 150 is movable in correspondence with the shapes of the side of the head and the ear of the user at the time of wearing of the headphone 100 by the user. Accordingly, the ear pad 160 comes to a position facing the user in accordance with conditions of each user.

Figure 8:
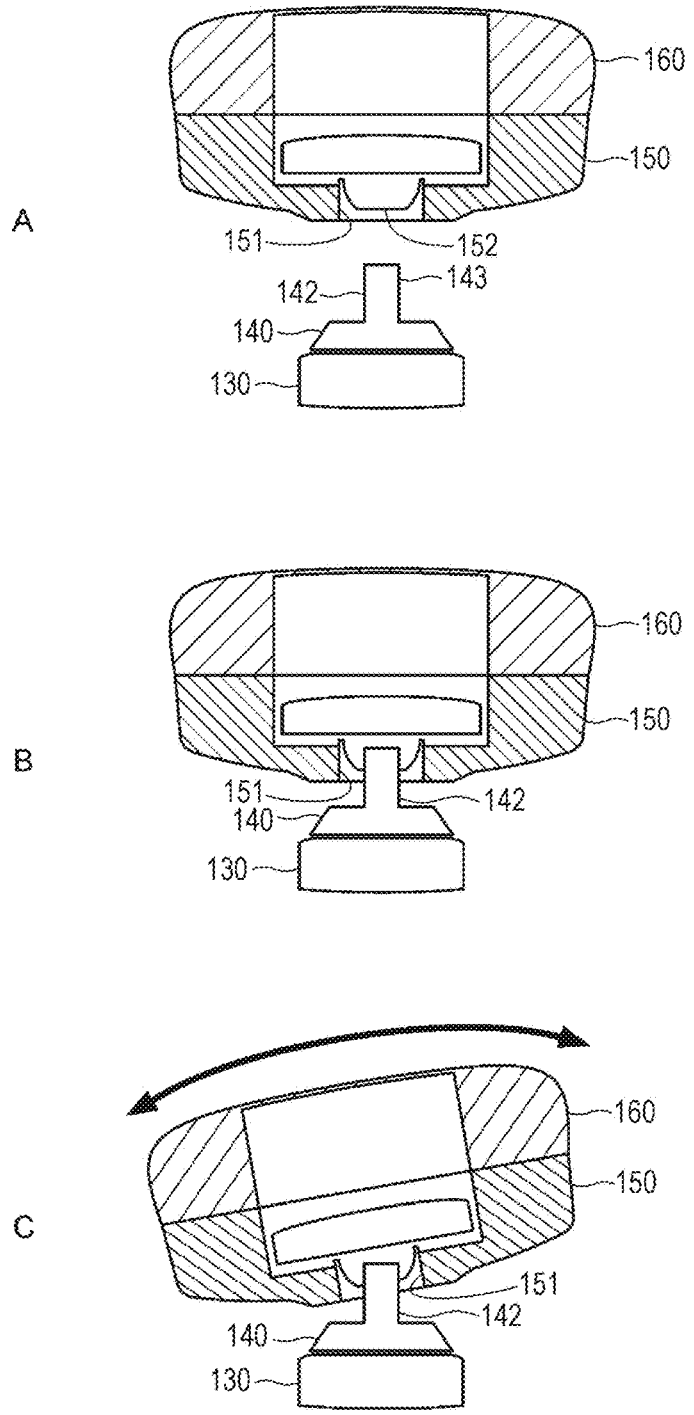
FIG. 8A shows a bottom view of the slider and a cross-sectional view of the housing and the ear pad as viewed from the bottom.
FIG. 8B is a bottom view of the slider in a state of connection between the slider and the housing.
FIG. 8C is a bottom view illustrating a state of connection between the slider and the housing, and a moving state of the housing.

FIGS. 8A to 8C are bottom views of the arm 130, the slider 140, the housing 150, and the ear pad 160. As illustrated in FIG. 8A, a recess 151 formed in the housing 150 is wider than the housing connection portion 142 of the slider 140. Accordingly, when the slider 140 is connected with the housing 150 as illustrated in FIG. 8B, the housing 150 becomes tiltable in the left-right direction as illustrated in FIG. 8C.

The housing 150 is tiltable in the longitudinal direction as discussed with reference to FIGS. 7A to 7D. Moreover, the housing 150 is also tiltable in the lateral direction as discussed with reference to FIGS. 8A to 8C. Furthermore, a contact portion between the housing 150 and the slider 140 is constituted by the projecting spherical surface 152 of the housing 150 and the recessed spherical surface 143 of the slider 140. These configurations realize the twisting action of the housing 150 in all directions. In this case, the followability of the housing 150 and the ear pad 160 increases and aligns the ear pad 160 with the position facing the ear of the user. Accordingly, the user is allowed to feel fitting comfort corresponding to the physical features and preferences of the user.

Figure 9:
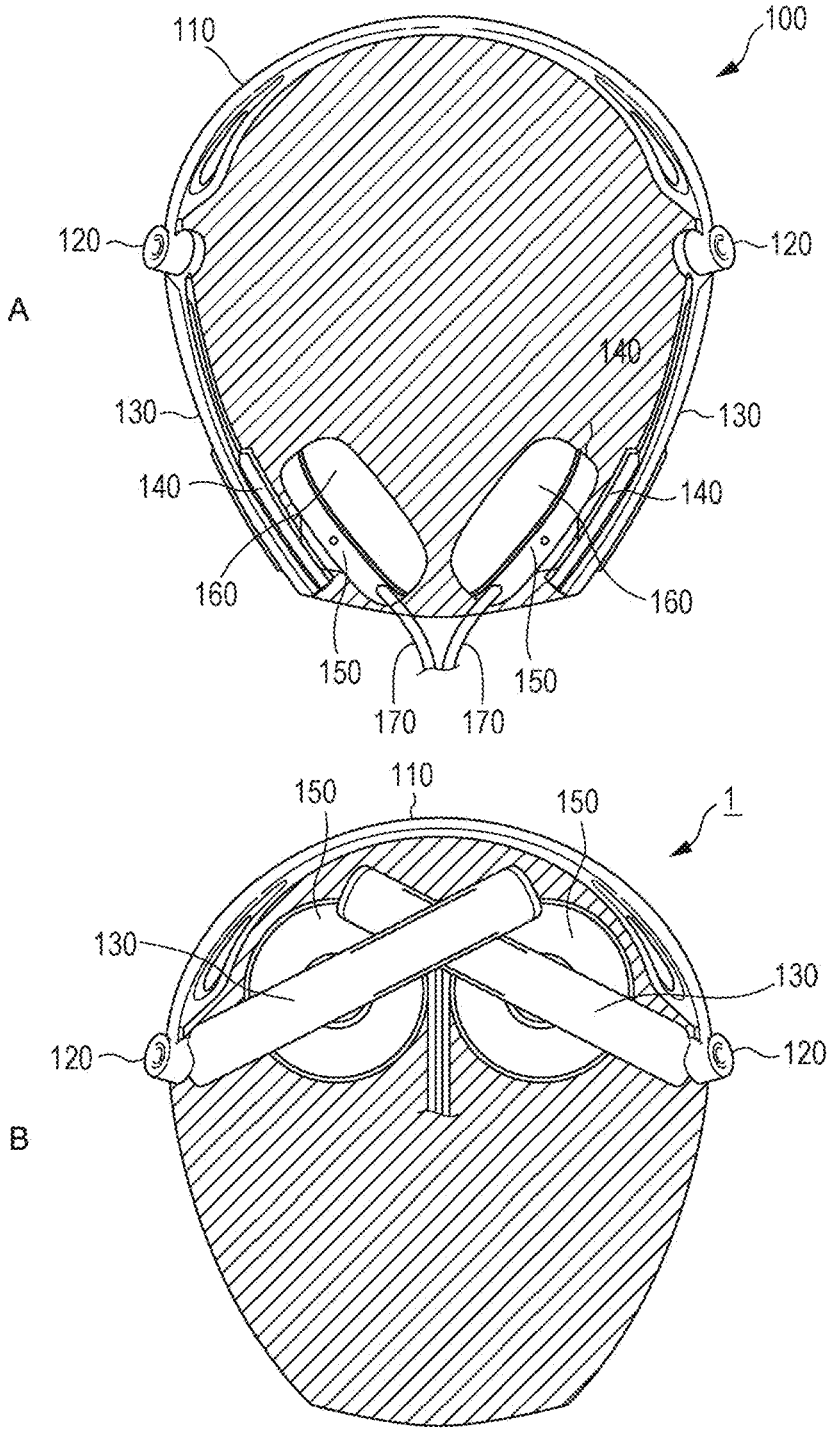

The headphone 100 according to the first embodiment is constructed as described above. An area surrounded by the headband 110 and the arm 130 (hatched area) in the use state is herein defined as illustrated in FIG. 9A. According to the headphone 100 in this embodiment, the housing 150 is contained in this hatched area in the folded state as illustrated in FIG. 9B. The headphone 100 in this embodiment is therefore folded, and brought into a compact condition while not used. In this condition, the L side arm 130 and the R side arm 130 overlap with each other at a position where the housings are located in the use state.

Figure 10:
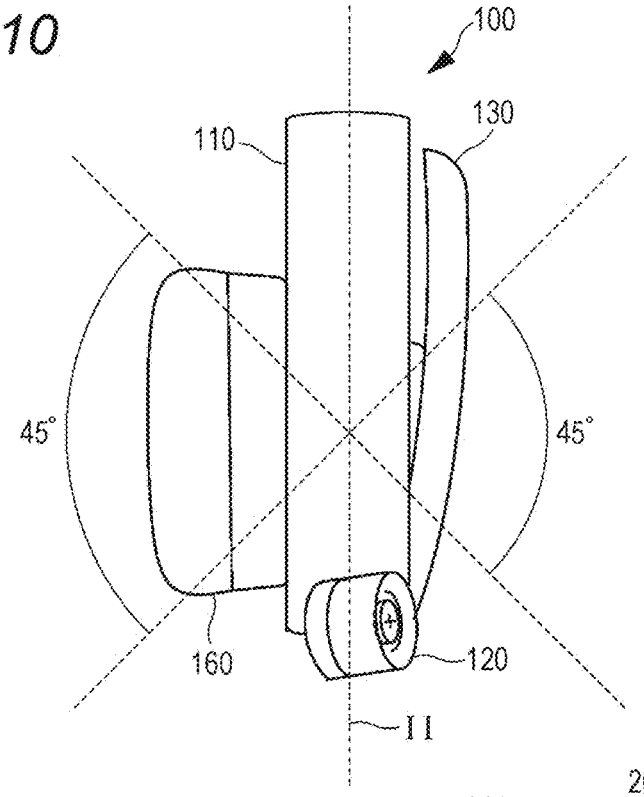
FIG. 10 is a view illustrating a state of the housing in the side view of the headphone.

Moreover, as illustrated in FIG. 10, it is preferable that the housing 150 is tilted in a range within ±45° with respect to a plane II substantially in parallel with the headband 110 in the folded state in the side view of the headphone 100.

According to this embodiment, both folding of the arm 130 and a directional change of the housing 150 are achievable by one rotation of the arm 130 around the axis of the one rotational shaft 120. Accordingly, the user is capable of rapidly and easily completing folding of the headphone 100. Moreover, only a pair of the rotational shafts 120 are needed as rotational shafts. In this case, the number of parts decreases, wherefore the manufacturing cost lowers.

The slider 140 is slidable wider than the use range corresponding to the position changeable range of the housing 150 during use of the headphone 100. In this case, the slider 140 is allowed to slide above the use range during folding. Accordingly, compactness of the headphone 100 increases.

At the time of folding of the arm 130, the slider 140 is slid to position the housing 150 at the upper end side of the arm 130 (in the vicinity of the center of the headphone 100 in the longitudinal direction). As a result, both the housings 150 are positioned side-by-side in the folded state as illustrated in FIG. 2B. In this case, the housings 150 do not overlap with each other, wherefore the thickness of the headphone 100 in the folded state further decreases.

In the folded state, the housings 150 do not cross each other. In other words, the L side housing 150 is positioned on the left side of the headphone 100. On the other hand, the R side housing 150 is positioned on the right side of the headphone 100. In this case, such a condition that the housings 150 cross each other, i.e., that the L side housing 150 is positioned on the right side of the headphone 100, and that the R side housing 150 is positioned on the left side of the headphone 100 does not occur. Accordingly, entanglement of the cords 170 connected with the housings 150 is avoidable.

Furthermore, in the folded state of the headphone 100, each of the ear pads 160 faces in the same direction as illustrated in FIG. 2B. Accordingly, flaws or other damage to the housings 150 are avoidable when the headphone 100 is placed on a desk, a table or the like with the ear pad 160 side facing downward.

<2. Second Embodiment>

[2-1. Configuration of Headphone]

Figure 12:
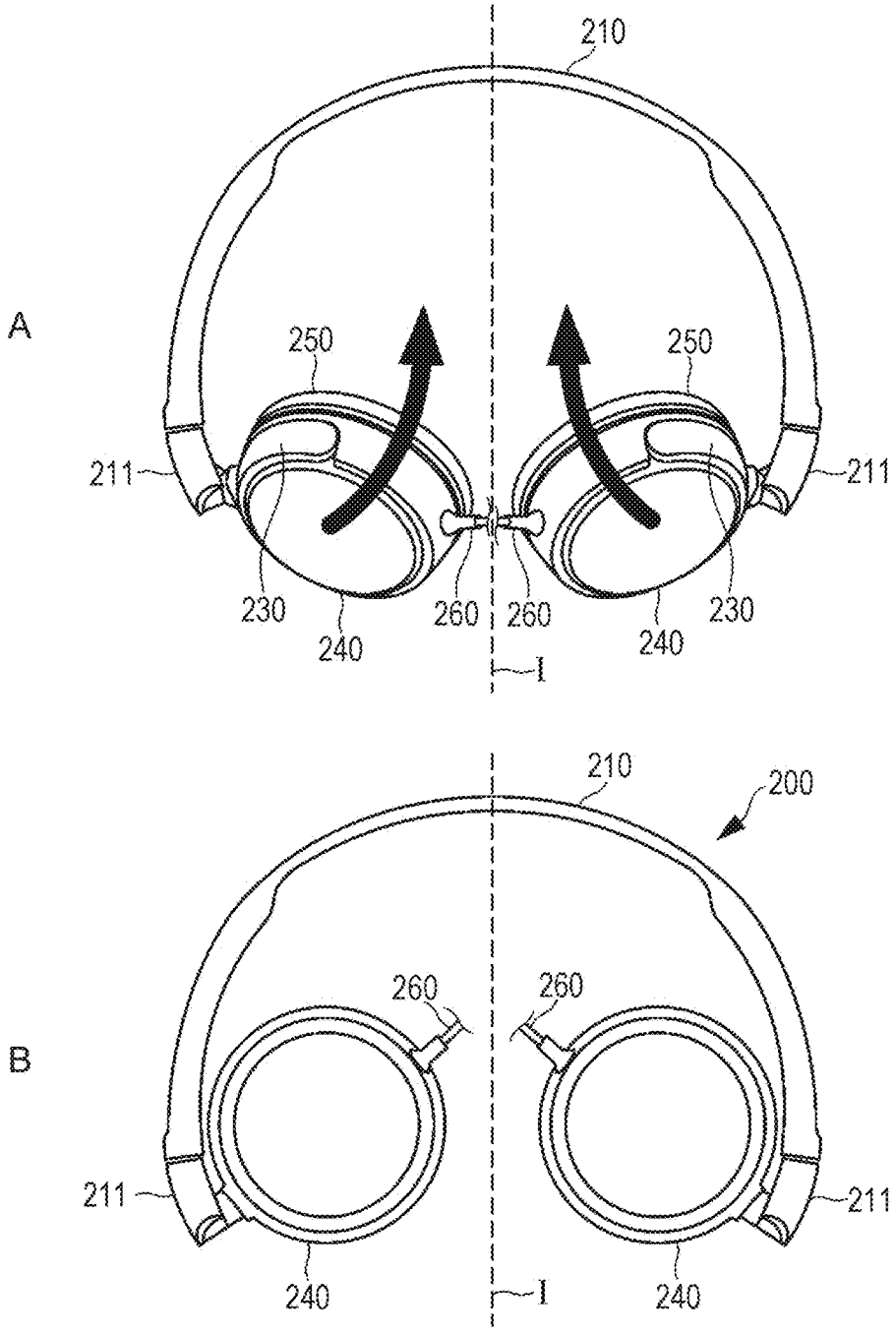

A second embodiment according to the present technology is hereinafter described. FIG. 11 and FIGS. 12A and 12B illustrate a general configuration of a headphone 200 according to the second embodiment. The headphone 200 includes a headband 210, rotational shafts 220, hangers 230, housings 240, ear pads 250, and cords 260.

The headband 210 is curved along the head of a user, and brought into contact with the top of the head of the user in a wearing state to support the entire headphone 200. The headband 210 is constituted by synthetic resin such as plastic, or metal, for example, and has flexibility produced by predetermined rigidity and elasticity of the headband 210. Accordingly, the headband 210 is capable of pressing the housings 240 and the ear pads 250 toward the side of the head of the user in the wearing state, thereby maintaining the wearing state of the headphone 200. A cushioning member such as rubber may be provided on a portion of the inner surface of the headband 210 in contact with the top of the head of the user.

According to the second embodiment, both ends of the headband 210 constitute sliders 211. The headband 210 expands and contracts in accordance with sliding of each of the sliders 211. Each of the hangers 230 shifts upward or downward with respect to the headband 210 in accordance with sliding of the corresponding slider 211.

During use of the headphone 200, each of the housings 240 and each of the ear pads 250 are aligned with a position facing the ear of the user by adjustment of the degree of expansion and contraction of the slider 211 in accordance with the size of the head of the user, the distance between the ear and the top of the head, or other conditions. This alignment produces fitting comfort in accordance with physical features and preferences of the user. On the other hand, when the headphone 200 is not used, the slider 211 is contracted to make the headphone 200 compact for storing space saving of the headphone 200.

The rotational shaft 220 is provided at an end of each of the sliders 211 of the headband 210 to rotatably support the corresponding hanger 230 with respect to the slider 211. The rotational shaft 220 is tilted with respect to the plane I located at equal distances from the left and right housings 240, similarly to the first embodiment. According to the second embodiment, the L side rotational shaft 220 and the R side rotational shaft 220 are disposed at bilaterally symmetric positions. The configuration of the rotational shafts 220 will be described later.

Each of the hangers 230 is provided at the tip of the corresponding slider 211 of the headband 210 to rotatably support the corresponding housing 240. Each of the hangers 230 rotatably supports the housing 240 via support pins (not shown) projecting inward from a pair of tips of the hanger 230. According to this structure, the direction of the housing 240 changes in accordance with the shape of an area around the ear of the user during wearing of the headphone 200, wherefore the housing 2405 is allowed to face the ear in a condition appropriate for the side shape of the head of the user. The hanger 230 corresponds to a support portion of the housing 240 according to the claims.

The housing 240 functions as an accommodating unit for accommodating an audio processing circuit, a speaker (both not shown), and others inside the housing 240. The housing 240 is made of synthetic resin such as plastic, for example. The audio processing circuit executes predetermined audio signal processes, such as a noise canceling process, a signal amplifying process, and an equalizing process. The speaker outputs audio signals processed by the audio processing circuit in the form of sound.

The ear pad 250 is configured to have elasticity, and provided on a surface of the housing 240 on the side opposite to the side of the head of the user. Each of the ear pads 250 interposed between the corresponding housing 240 and the side of the head of the user functions as a cushioning member between the housing 240 and the side of the head of the user. More specifically, the ear pad 250 prevents discomfort or pain given to the user from the housing 240 made of hard and not easily deformable material and coming into direct contact with the side of the head of the user during waring of the headphone 200.

In addition, each of the ear pads 250 has a function of improving sound quality, such as enhancement of reproduction of a low range, by sealing a space formed by the ear pad 250 and the side of the head of the user when the ear pad 250 is ring-shaped. Moreover, each of the ear pads 160 has a function of preventing leakage of sound to the outside after output of sound from the speaker. Furthermore, each of the ear pads 250 has a function of blocking noise entering from the outside to allow the user to more easily hear sound generated from the speaker.

Each of the cords 260 is a cord into which a lead, a ground line and the like are inserted, as a cord through which audio signals are transmitted. One end of each of the cords 260 is connected with the audio processing circuit accommodated in the housing 240. A plug (not shown) is provided at the other end of the cord 260. This plug is connected with an audio reproduction device (not shown) such as an MP3 player for connection between the headphone 2001 and the audio reproduction device.

The cord 260 may be only connected with either the L side housing 240 or the R side housing 240. In this case, an L channel lead, an R channel lead, and a ground line are inserted into the cord 260. A connection cord (not shown) is further provided between the housing 240 connected with the cord 260, and the other housing 240 not connected with the cord 260 to drive the speaker within the other housing 240 not connected with the cord 260. This connection cord is connected with the cord 260 or the audio processing circuit within the housing 240 connected with the cord 260, and inserted into the sliders 211, arms, and the headband 210 to connect with the audio processing circuit within the other housing 240. Audio signals are transmitted via this connection cord to the audio processing circuit within the other housing 240 not connected with the cord 260.

According to the headphone 200 in the second embodiment, each of the hangers 230 is folded toward the headband 210 when the headphone 200 is not used as illustrated in FIG. 12A. As a result, the headphone 200 is brought into a folded state as illustrated in FIG. 12B. This state is hereinafter referred to as a folded state. Each of the housings 240 changes in direction from a state facing the plane I located at equal distances from the L side and R side housings 240 (state in FIG. 11), to a state substantially perpendicular to the plane I (state in FIG. 12B) in the folded state. This change applies to the ear pads 250 provided on the housings 240. When the headphone 200 is not used or carried to a different place, for example, the headphone 200 is brought into the folded state for size reduction of the headphone 200, thereby achieving space saving for storage of the headphone 200.

Figure 14:
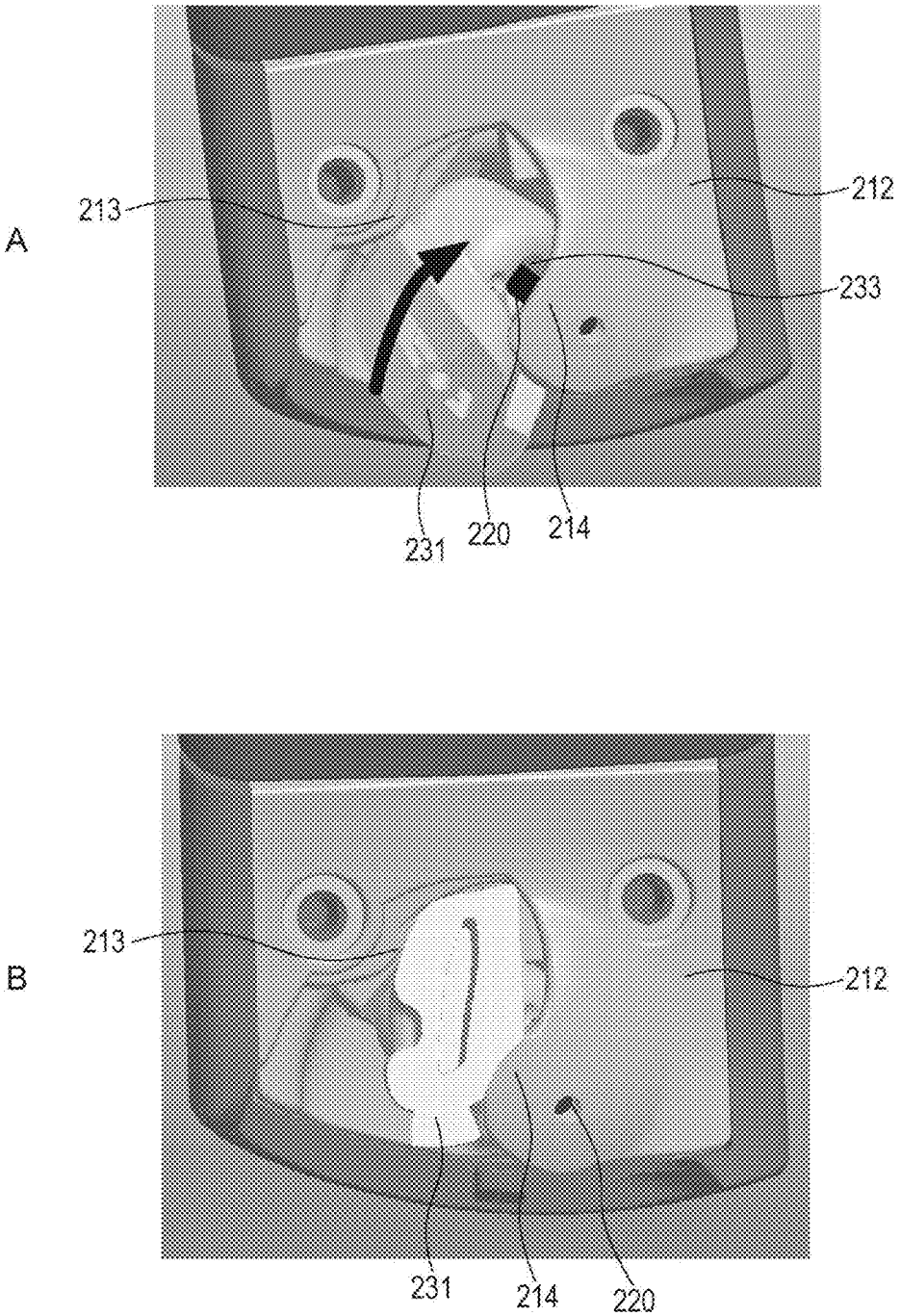
FIGS. 14A and 14B are partially enlarged side views illustrating a connection state between a headband and a hanger.
Figure 15:
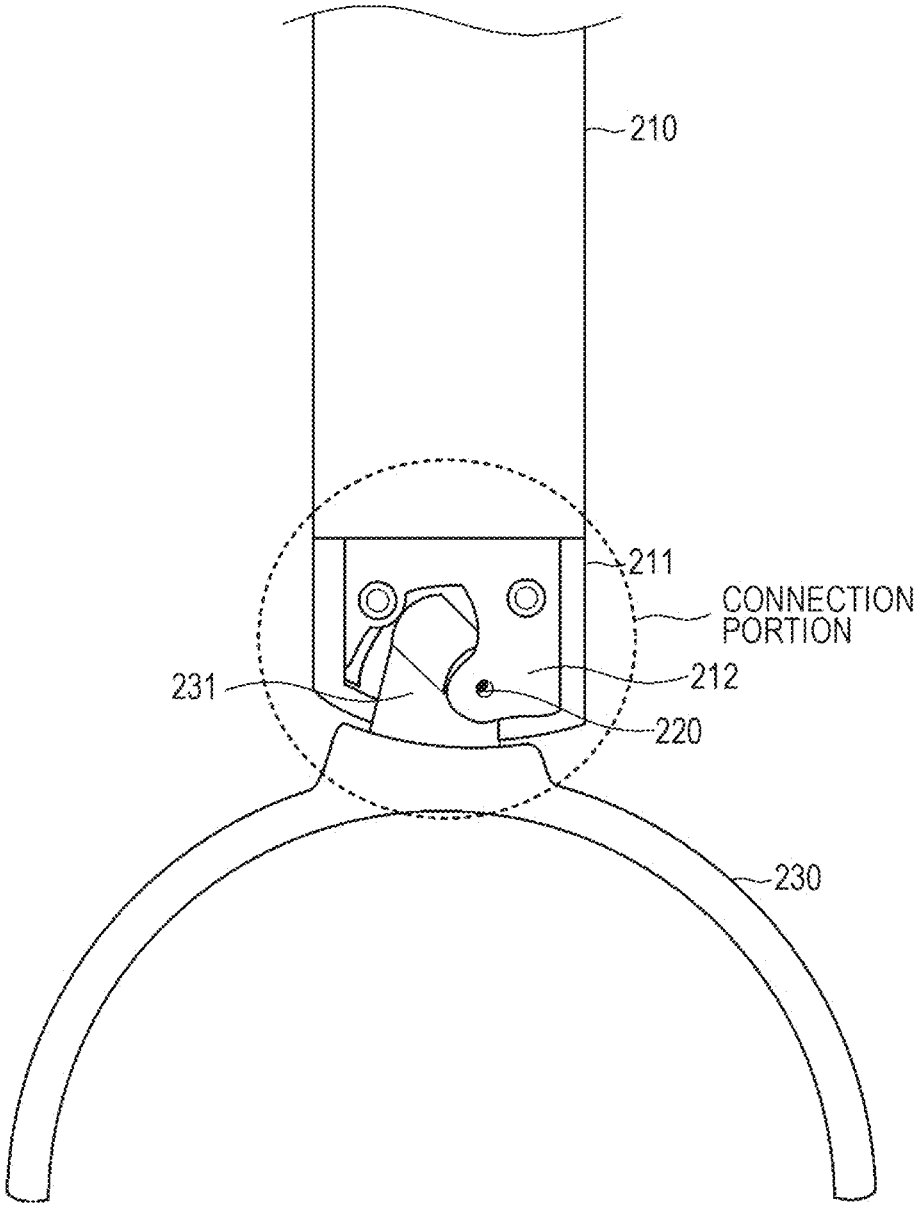
FIG. 15 is a view illustrating a connection state of the headband and the hanger.

Connection between the slider 211 of the headband 210 and the hanger 230 is now described. FIGS. 14A and 14B are partially enlarged views of a connection portion between the slider 211 and the hanger 230 illustrated in FIG. 15, as viewed from the inside of the headphone 200. A connection portion provided at a tip of the slider 211 and connected with the hanger 230 is referred to as a slider side connection portion 212. A connection portion provided in the vicinity of the top of the hanger 230 and connected with the slider side connection portion 212 is referred to as a hanger side connection portion 231. The hanger side connection portion 231 in a broken state is shown for convenience of explanation.

The rotational shaft 220 is tilted in a diagonal direction with respect to the plane I located at equal distances from the left and right housings 240 as illustrated in FIG. 11, similarly to the first embodiment. Both ends of the rotational shaft 220 are supported by the slider side connection portion 212 in a state of insertion of the rotational shaft 220 into a shaft insertion hole 233 formed in the hanger side connection portion 231. This structure allows rotation of the hanger 230 with respect to the slider 211. A method similar to the method described in the first embodiment with reference to FIGS. 4A to 4E is adopted for determining the position and tilt of the rotational shaft 220.

Figure 13:
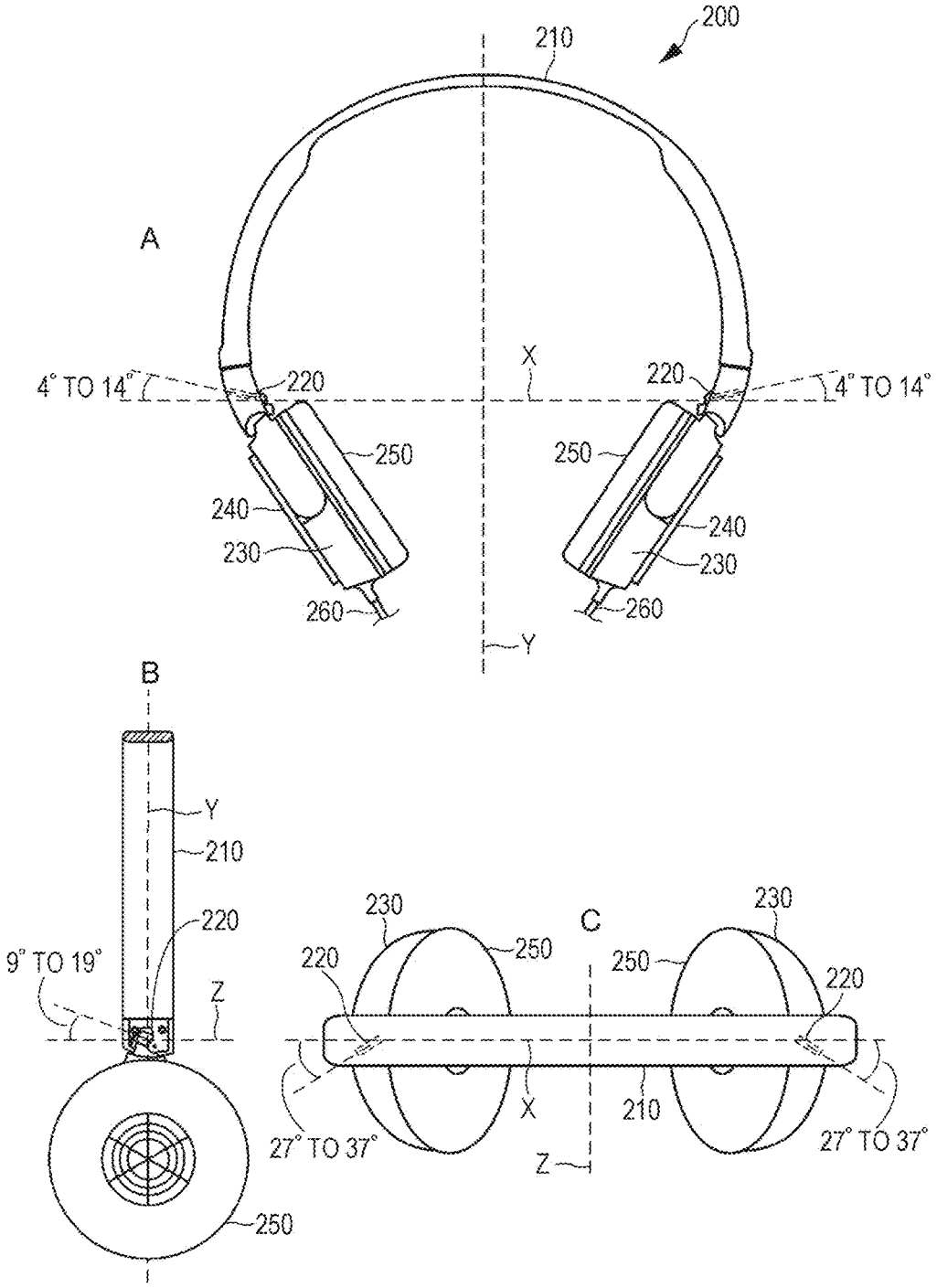
FIG. 13A is a view illustrating an angle of each rotational shaft in the X-Y plane.
FIG. 13B is a view illustrating an angle of each rotational shaft in the Y-Z plane.
FIG. 13C is a view illustrating an angle of each rotational shaft in the X-Z plane.

It is preferable that the rotational shaft 220 is disposed at an angle approximately in a range from 4° to 14° with respect to an X axis perpendicular to a Y axis dividing an arc of the headband 210 into equal two parts in the front view of the headphone 200, as illustrated in FIG. 13A. It is further preferable that the rotational shaft 220 is disposed at an angle of approximately 9° with respect to the X axis in the front view.

It is further preferable that the rotational shaft 220 is disposed at an angle approximately in a range from 9° to 19° with respect to a Z axis substantially in parallel with the width direction of the headband 210 in the side view of the headphone 200 as illustrated in FIG. 13B. It is further preferable that the rotational shaft 220 is disposed at an angle of approximately 14° with respect to the Z axis in the side view.

It is further preferable that the rotational shaft 220 is disposed at an angle approximately in a range from 27° to 37° with respect to the X axis substantially in parallel with the longitudinal direction of the headband 210 in the top view of the headphone 200 as illustrated in FIG. 13C. It is further preferable that the rotational shaft 220 is disposed at an angle of approximately 32° with respect to the X axis in the top view.

FIG. 14A illustrates the hanger 230 in the middle of rotation and not yet completely folded. FIG. 14B illustrates a completely folded state of the hanger 230. The slider side connection portion 212 includes a projection-shaped first and second clicks 213 and 214. When the hanger 230 is rotated and brought into the folded state, the state illustrated in FIG. 14A is changed to the state illustrated in FIG. 14B.

In this case, the hanger side connection portion 231 is caught by the first click 213 as illustrated in FIG. 14B. In addition, the hanger side connection portion 231 climbs over the second click 214. Accordingly, the hanger 230 is supported and not opened by gravity in the folded state.

A transition from the folded state to the use state is now described. FIG. 16, and FIGS. 17A, 17B, and 17C are partial enlarged views of a connection portion of the slider 211 and the hanger 230 illustrated in FIG. 18 and viewed from below. FIG. 18 illustrates a folded state of the hanger 230.

Figure 16:
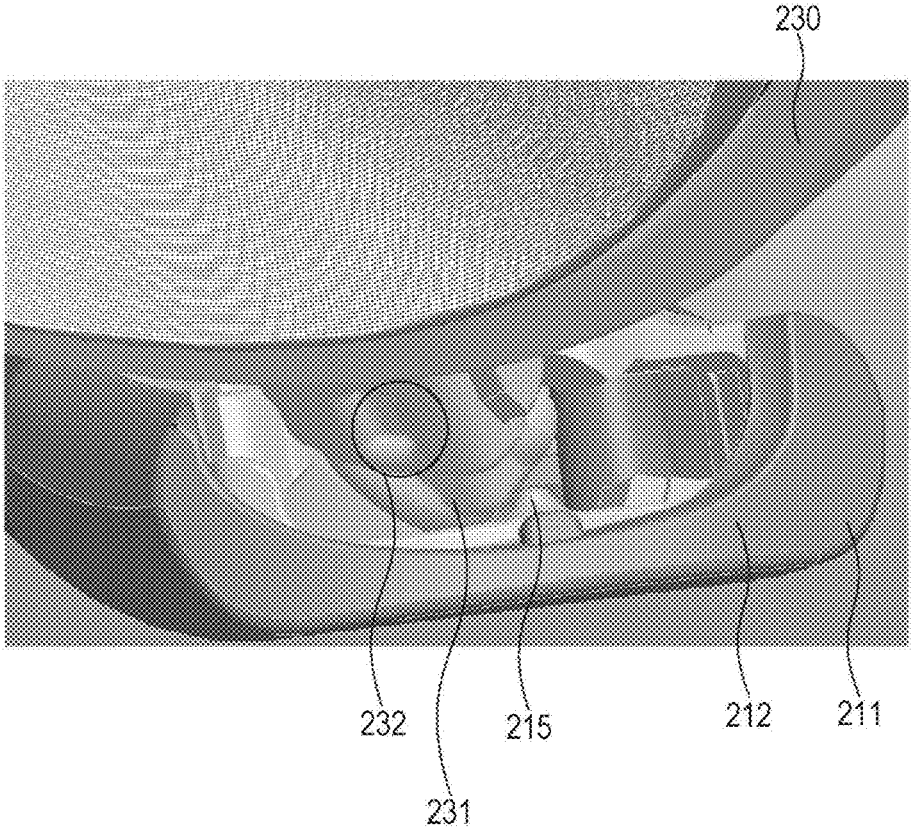
FIG. 16 is a partially enlarged view illustrating the connection state between the headband and the hanger.

FIG. 16 illustrates a folded state of the hanger 230. A projection-shaped third click 215 is provided on the slider side connection portion 212. On the other hand, a recessed portion 232 having a recessed shape is formed in the hanger side connection portion 231.

Figure 17:
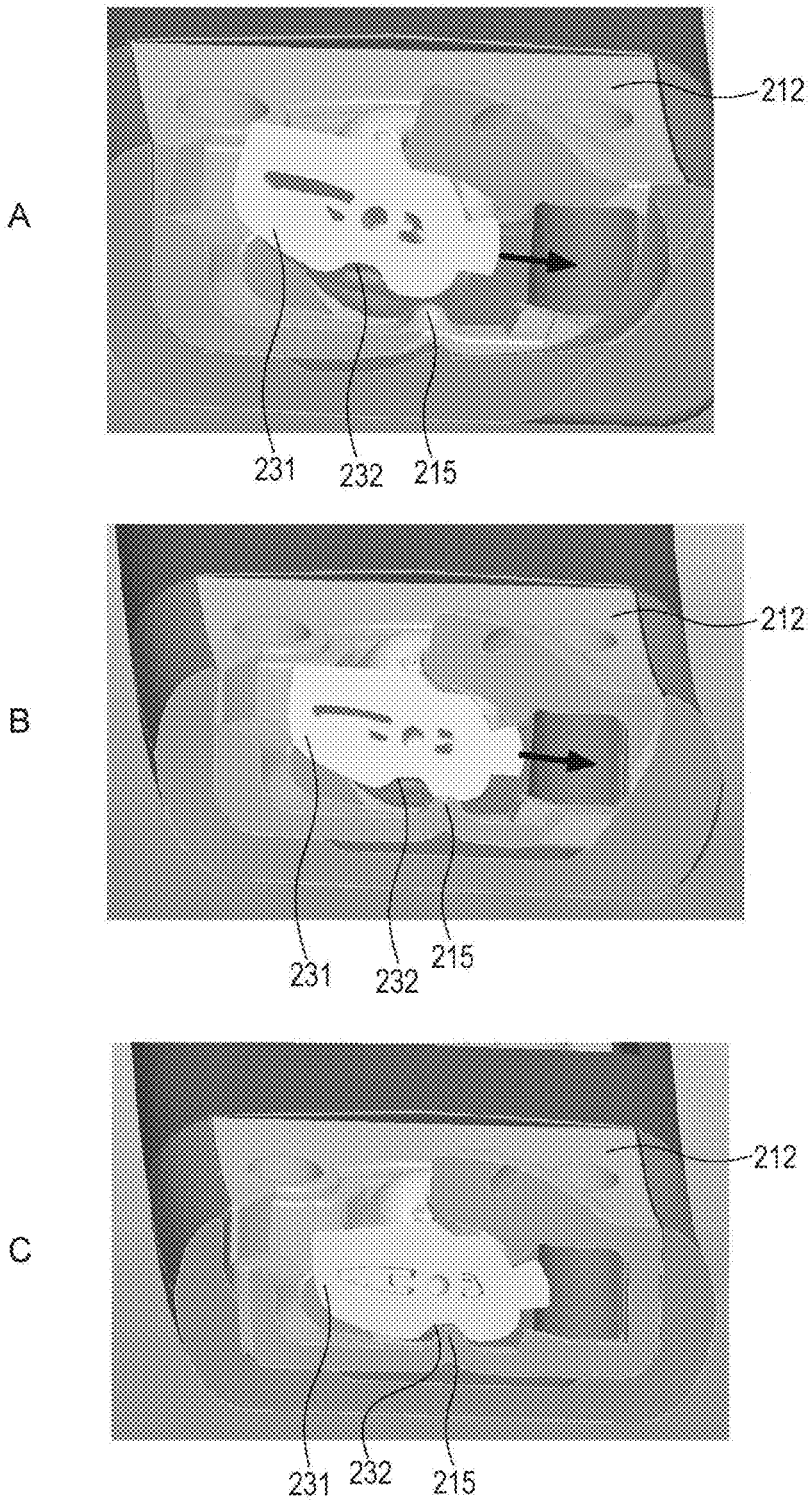
FIGS. 17A to 17C are partially enlarged views illustrating folding processes in a state of connection between the headband and the hanger.
Figure 18:
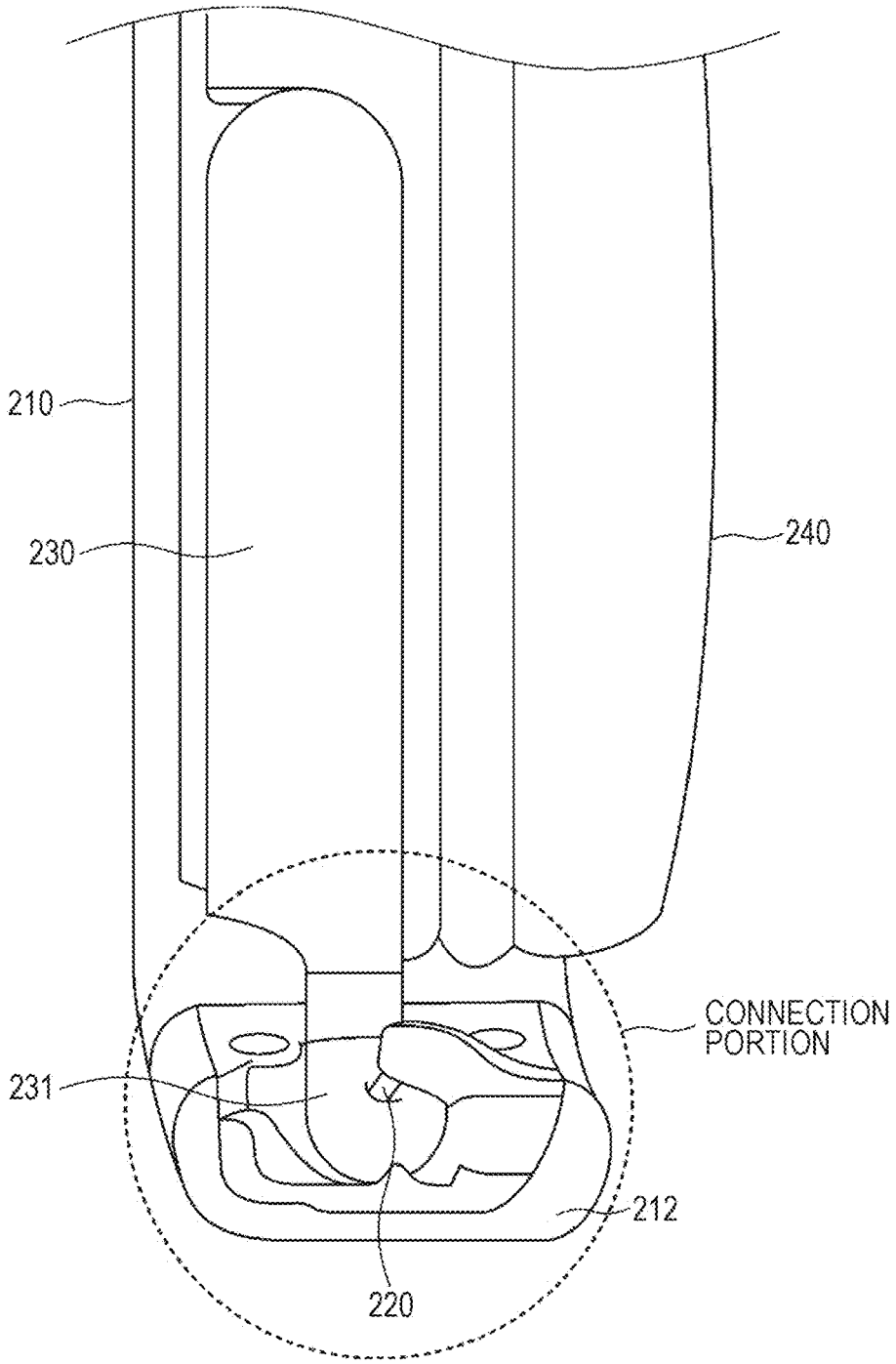
FIG. 18 is a view illustrating the connection state between the headband and the hanger.

FIGS. 17A to 17C illustrate processes from the folded state to the use state along with opening of the housing 240. When the state illustrated in FIG. 17A changes to the state illustrated in FIG. 17B and further to the use state, the third click 215 of the slider side connection portion 212 is inserted into the recessed portion 232 of the hanger side connection portion 231, and caught by the recessed portion 232 as illustrated in FIG. 17C. As a result, the state of the hanger 230 is fixed, whereby unnecessary movement of the hanger 230 is prevented during use of the headphone 200. In this case, the user is capable of realizing the state that the hanger 230 is completely opened, based on click feeling given to the user when the third click 215 is inserted into the recessed portion 232 of the hanger side connection portion 231

At the time of a transition from the use state to the folded state, the recessed portion 232 of the hanger side connection portion 231 climbs over the third click 215, whereby the hanger 230 is brought into the folded state as illustrated in FIG. 17B. In this case, the user is capable of realizing the state that the hanger 230 is released from the completely opened state, based on click feeling given to the user when the hanger side connection portion 231 climbs over the third click 215.

Figure 19:
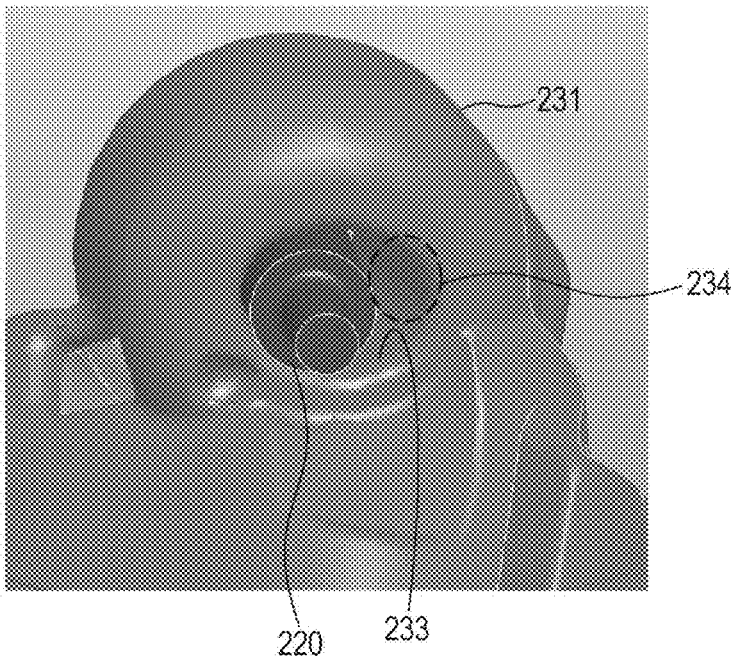
Figure 19:
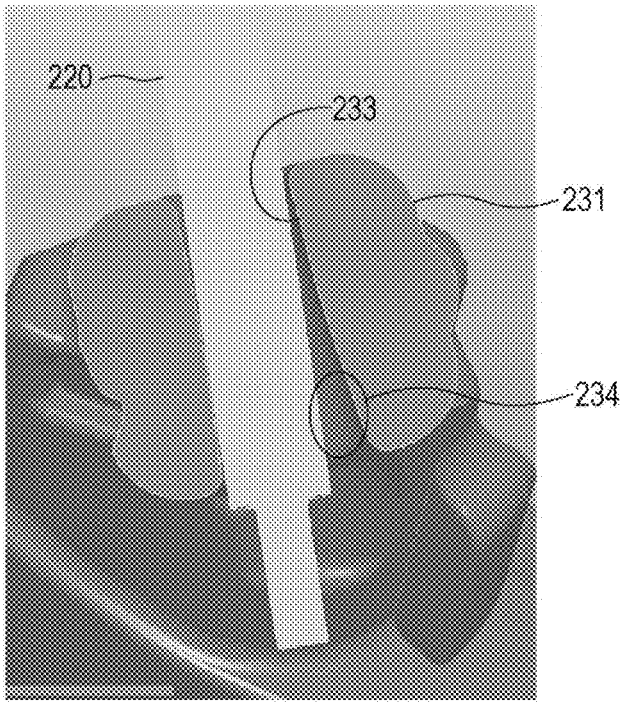

A configuration for allowing a twisting action of the housing 240 is now described. FIG. 19A illustrates the hanger side connection portion 231 and the rotational shaft 220 inserted into the shaft insertion hole 233 of the hanger side connection portion 231. FIG. 19B is a cross-sectional view of the shaft insertion hole 233 of the hanger side connection portion 231, and the shaft. In this case, the rotational shaft 220 is inserted into the shaft insertion hole 233 of the hanger side connection portion 231, and connected with the slider side connection portion 212 in the state of connection between the hanger 230 and the slider 211. However, the slider 211 is not shown in FIGS. 19A and 19B for convenience of explanation.

As illustrated in FIG. 19B, the shaft insertion hole 233 of the hanger side connection portion 231 has a larger diameter on one opening side. This structure produces looseness 234 of the shaft insertion hole 233. The looseness 234 allows the twisting action of the hanger 230 relative to the rotational shaft 220. In this case, the housing 240 connected with the hanger 230 also performs the twisting action. Accordingly, the followability of the housing 240 and the ear pad 250 increases, and aligns the ear pad 250 with the position facing the ear of the user, in which condition the user is capable of obtaining fitting comfort in accordance with the physical features and preferences of the user.

The headphone 200 according to the second embodiment is constructed as described above. According to the first embodiment, the rotational shaft 120 corresponding to a fulcrum of the rotation for folding is disposed above the slider 140. According to the second embodiment, however, the rotational shaft 220 is disposed below the slider 211. In this case, the headphone 200 having either of these configurations is easily foldable, and becomes compact in size in a condition after folding.

Figure 20:
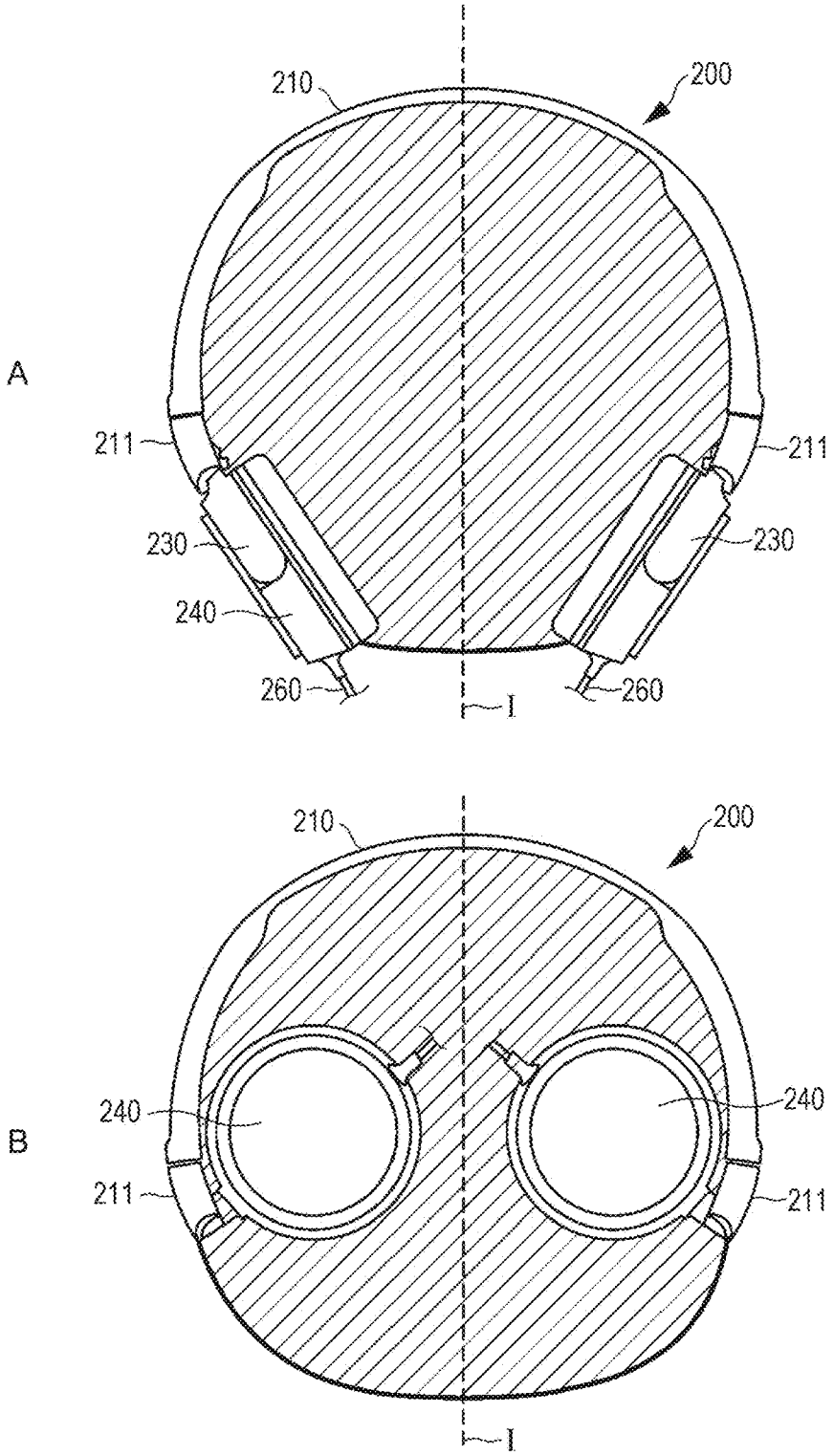

An area (hatched area) inside the headphone 200 in the use state is herein defined as illustrated in FIG. 20A. According to the headphone 200 in this embodiment, the housings 240 are contained in this hatched area in the folded state as illustrated in FIG. 20B. The headphone 200 in this embodiment is therefore foldable and made compact while not used.

According to the headphone 200 in the second embodiment, it is preferable that the housing 240 is tilted at an angle in a range within ±45° with respect to the plane II substantially in parallel with the headband 210 in the side view of the headphone 200 in the folded state, similarly to the first embodiment.

According to the second embodiment, folding of the headphone 200 is achievable by one rotation of the hanger 230 around the axis of the one rotational shaft 220. Accordingly, the user is capable of rapidly and easily completing folding of the headphone 200.

Moreover, both the housings 240 are positioned side-by-side in the folded state illustrated in FIG. 12B. In this case, the housings 240 do not overlap with each other, wherefore the thickness of the headphone 200 in the folded state further decreases.

In the folded state, the housings 240 do not cross each other in the folded state. In other words, the L side housing 240 is positioned on the left side of the headphone 200. On the other hand, the R side housing 240 is positioned on the right side of the headphone 200. In this case, such a condition that the housings 240 cross each other, i.e., that the L side housing 240 is positioned on the right side of the headphone 200, and that the R side housing 240 is positioned on the left side of the headphone 200 does not occur. Accordingly, entanglement of the cords 260 connected with the housings 240 is avoidable.

Furthermore, in the folded state of the headphone 200, each of the ear pads 250 faces in the same direction as illustrated in FIG. 12B. Accordingly, flaws or other damage are not given to the housings 240 when the headphone 200 is placed on a desk, a table or the like with the ear pads 250 side facing downward.

<3. Modified Examples>

While the specific embodiments of the present technology have been described, the present technology is not limited to the respective embodiments described herein, but includes various modifications made based on the technical concepts of the present technology.

Figure 21:
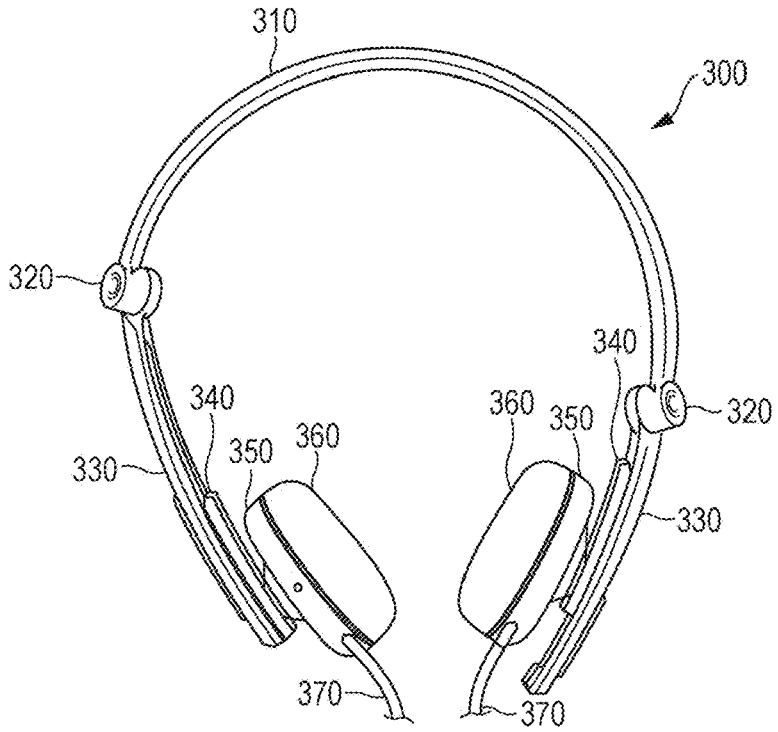
Figure 21:
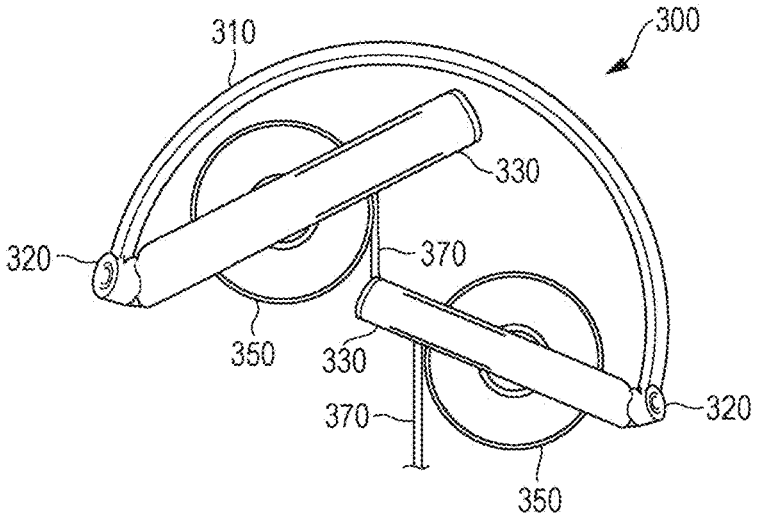

FIGS. 21A and 21B illustrate an external appearance of a headphone according to a modified example of the first embodiment of the present technology. FIG. 21A illustrates a use state, while FIG. 21B illustrates a folded state.

A headphone 300 according to this modified example is constituted by a headband 310, rotational shafts 320, arms 330, sliders 340, housings 350, ear pads 360, and cords 370. The respective configurations are similar to the corresponding configurations of the first embodiment, wherefore explanation of these configurations is not repeated herein.

According to the first embodiment described above, the pair of rotational shafts 120 on the L side and the R side are disposed at bilaterally symmetric positions. On the other hand, according to the headphone 300 in the modified example, the pair of rotational shafts 320 on the L side and the R side are bilaterally asymmetric.

When the rotational shafts 320 at the folding positions of the arms 330 are bilaterally asymmetric, the headphone 300 in the folded state comes to a position illustrated in FIG. 21B. In the folded state illustrated in FIG. 21B, the folding positions of the arms 330 are not aligned in the left-right direction due to bilateral asymmetry of the left and right rotational shafts 320. In this case, the arms 330 do not overlap with each other in the folded state, wherefore the thickness of the headphone 300 in the folded state further decreases.

The present technology may have the following configurations.

(1)

A headphone including:

a headband;

a pair of housing support portions, one and the other of which are provided at one and the other ends of the headband, respectively;

a pair of rotational shafts, one and the other of which rotatably connects one and the other of the pair of housing support portions to the headband, respectively;

a pair of housings, one and the other of which are provided on one and the other of the pair of housing support portions, respectively, wherein, in a folded state of the housing support portions as a result of a rotation, the pair of housings are disposed in positions contained within an area inside an arc formed by the headband and the housing support portions in an opened state of the housing support portions, and are located side by side without crossing each other; and a pair of ear pads, one and the other of which are provided on one and the other of the pair of housings, respectively.

(2)

The headphone according to (1) noted above, wherein the rotational shafts are tilted to allow folding of the housing support portions and directional changes of the ear pads after the folding by one rotation.

(3)

The headphone according to (1) or (2) noted above, wherein the pair of ear pads face substantially in the same direction in the folded state of the housing support portions.

(4)

The headphone according to any one of (1) to (3) noted above, wherein each of the housing support portions includes an arm connected with the headband via the corresponding rotational shaft, and a slider slidably provided with respect to the arm and sliding along the arm to adjust the position of the corresponding housing.

(5)

The headphone according to (4) noted above, wherein a slidable range of the slider is wider than a position changeable range of the housing during use of the headphone by a user.

(6)

The headphone according to (5) noted above, wherein each of the housing support portions includes a first position fixing mechanism for fixing the position of the corresponding housing in the position changeable range of the corresponding housing during use of the headphone.

(7)

The headphone according to (6) noted above, wherein the first position fixing mechanism is capable of fixing the corresponding housing to a plurality of positions.

(8)

The headphone according to (5) noted above, wherein each of the housing support portions includes a second position fixing mechanism for fixing the position of the corresponding housing in an area out of the position changeable range of the corresponding housing during use of the headphone.

(9)

The headphone according to (4) noted above, wherein each of the sliders is disposed below the corresponding rotational shaft.

(10)

The headphone according to any one of (1) to (9) noted above, wherein the pair of rotational shafts are disposed at bilaterally symmetric positions.

(11)

The headphone according to any one of (1) to (10) noted above, wherein each of the housings is movable in accordance with a side shape of the head of the user.

(12)

The headphone according to any one of (1) to (11) noted above, wherein each of the housings is movable in accordance with a side shape of the head of the user.

(13)

The headphone according to any one of (1) to (12) noted above, wherein one and another cords are connected with one and the other of the pair of housings, respectively, and the cords are connected in such positions that each connection portion for connection between the corresponding housing and the corresponding cord does not contact the other connection portion in the folded state of the pair of housing support portions.

(14)

The headphone according to (4) noted above, wherein the arms in the folded state overlap with each other at a position where the housings are present during use of the headphone by the user.

(15)

The headphone according to any one of (1) to (14) noted above, wherein the housing support portions are hangers that support the housings.

(16)

The headphone according to (15) noted above, wherein the headband includes sliders each of which moves the corresponding hanger upward and downward, and each of the sliders is disposed above the corresponding rotational shaft.

(17)

The headphone according to any one of (1) to (16) noted above, wherein each of the housings is contained within ±45° with respect to a plane substantially in parallel with the headband in a side view in the folded state of each of the housing support portions.

(18)

The headphone according to (2) noted above, wherein the rotational shaft is disposed at an angle within a range from 4° to 22° with respect to an X axis direction perpendicular to a Y axis direction that divides the arc of the headband into two equal parts in a front view, the rotational shaft is disposed at an angle within a range from 9° to 29° with respect to a Z axis direction substantially in parallel with a width direction of the headband in a side view, and the rotational shaft is disposed at an angle within a range from 27° to 39° with respect to the X axis in a top view.

(19)

The headphone according to (18) noted above, wherein the rotational shaft is disposed at an angle of 17° with respect to the X axis in the front view, an angle of 24° with respect to the Z axis in the side view, and an angle of 34° with respect to the X axis in the top view.

(20)

The headphone according to (18) noted above, wherein the rotational shaft is disposed at an angle of 9° with respect to the X axis in the front view, an angle of 14° with respect to the Z axis in the side view, and an angle of 32° with respect to the X axis in the top view.

REFERENCE SIGNS LIST

| | |
|---|---|
| 100, 200, 300 | Headphone |
| 110, 210, 310 | Headband |
| 120, 220, 320 | Rotational shaft |
| 130, 330 | Arm |
| 140, 340 | Slider |
| 150, 240, 350 | Housing |
| 160, 250, 360 | Ear pad |
| 170, 260, 370 | Cord |
| 230 | Hanger |

What is claimed is:

1. A headphone, comprising:

a headband;

a pair of housing support portions, one and the other of which are provided at one and the other ends of the headband, respectively;

a pair of rotational shafts, one and the other of which rotatably connects one and the other of the pair of housing support portions to the headband, respectively;

a pair of housings, one and the other of which are provided on one and the other of the pair of housing support portions, respectively, wherein, in a folded state of the housing support portions as a result of a rotation, the pair of housings are disposed in positions contained within an area inside an arc formed by the headband, wherein each of the housing support portions includes an arm connected with the headband via the corresponding rotational shaft, and a slider slidably provided with respect to the arm and sliding along the arm to adjust the position of the corresponding housing, wherein, when transitioning between a use state and the folded state, each of the housings slides along the corresponding arm, and wherein, in the folded state, the arms cross one another; and a pair of ear pads, one and the other of which are provided on one and the other of the pair of housings, respectively.

2. The headphone according to claim 1, wherein the rotational shafts are tilted to allow folding of the housing support portions and directional changes of the ear pads after the folding by one rotation.

3. The headphone according to claim 1, wherein the pair of earpads face substantially in the same direction in the folded state of the housing support portions.

4. The headphone according to claim 1, wherein a slidable range of the slider is wider than a position changeable range of the housing during use of the headphone by a user.

5. The headphone according to claim 4, wherein each of the housing support portions includes a first position fixing mechanism for fixing the position of the corresponding housing in the position changeable range of the corresponding housing during use of the headphone.

6. The headphone according to claim 5, wherein the first position fixing mechanism is capable of fixing the corresponding housing to a plurality of positions.

7. The headphone according to claim 4, wherein each of the housing support portions includes a second position fixing mechanism for fixing the position of the corresponding housing in an area out of the position changeable range of the corresponding housing during use of the headphone.

8. The headphone according to claim 1, wherein each of the sliders is disposed below the corresponding rotational shaft.

9. The headphone according to claim 1, wherein the pair of rotational shafts are disposed at bilaterally symmetric positions.

10. The headphone according to claim 1, wherein the pair of rotational shafts are disposed at bilaterally asymmetric positions.

11. The headphone according to claim 1, wherein each of the housings is movable in accordance with a side shape of the head of the user.

12. The headphone according to claim 1, wherein one and another cords are connected with one and the other of the pair of housings, respectively, and the cords are connected in such positions that each connection portion for connection between the corresponding housing and the corresponding cord does not contact the other connection portion in the folded state of the pair of housing support portions.

13. The headphone according to claim 1, wherein the arms in the folded state overlap with each other at a position where the housings are present during use of the headphone by the user.

14. The headphone according to claim 1, wherein the housing support portions are hangers that support the housings.

15. The headphone according to claim 14, wherein the headband includes sliders each of which moves the corresponding hanger upward and downward, and each of the sliders is disposed above the corresponding rotational shaft.

16. The headphone according to claim 1, wherein each of the housings is contained within ±45° with respect to a plane substantially in parallel with the headband in a side view in the folded state of each of the housing support portions.

17. The headphone according to claim 2, wherein the rotational shaft is disposed at an angle within a range from 4° to 22° with respect to an X axis direction perpendicular to a Y axis direction that divides the arc of the headband into two equal parts in a front view, the rotational shaft is disposed at an angle within a range from 9° to 29° with respect to a Z axis direction substantially in parallel with a width direction of the headband in a side view, and the rotational shaft is disposed at an angle within a range from 27° to 39° with respect to the X axis in a top view.

18. The headphone according to claim 17, wherein the rotational shaft is disposed at an angle of 17° with respect to the X axis in the front view, an angle of 24° with respect to the Z axis in the side view, and an angle of 34° with respect to the X axis in the top view.

19. The headphone according to claim 17, wherein the rotational shaft is disposed at an angle of 9° with respect to the X axis in the front view, an angle of 14° with respect to the Z axis in the side view, and an angle of 32° with respect to the X axis in the top view.

* * * * *